US009452451B2

(12) United States Patent
Kleiner et al.

(10) Patent No.: US 9,452,451 B2
(45) Date of Patent: Sep. 27, 2016

(54) CLEANING DEVICE AND CLEANING BRUSH FOR AN ATOMIZER AND CORRESPONDING CLEANING METHOD

(75) Inventors: Marcus Kleiner, Besigheim (DE); Michael Baumann, Flein (DE); Thomas Buck, Sachsenheim (DE); Ralf Schäfer, Ludwigsburg (DE); Georg M. Sommer, Ludwigsburg (DE); Martin Wurst, Heilbronn (DE); Frank Herre, Oberriexingen (DE)

(73) Assignee: Durr Systems GmbH, Bietigheim-Bissingen (DE)

( * ) Notice: Subject to any disclaimer, the term of this patent is extended or adjusted under 35 U.S.C. 154(b) by 211 days.

(21) Appl. No.: 13/989,127

(22) PCT Filed: Nov. 2, 2011

(86) PCT No.: PCT/EP2011/005527

§ 371 (c)(1),
(2), (4) Date: Nov. 27, 2013

(87) PCT Pub. No.: WO2012/069137

PCT Pub. Date: May 31, 2012

(65) Prior Publication Data

US 2014/0075695 A1 Mar. 20, 2014

(30) Foreign Application Priority Data

Nov. 26, 2010 (DE) ..... 10 2010 052 698

(51) Int. Cl.
*A46B 13/00* (2006.01)
*B08B 1/00* (2006.01)
(Continued)

(52) U.S. Cl.
CPC ..... *B08B 1/002* (2013.01); *B05B 15/0208* (2013.01); *B05B 15/0258* (2013.01); *B08B 1/04* (2013.01); *A46B 13/001* (2013.01); *B08B 3/02* (2013.01)

(58) Field of Classification Search
CPC . A46B 13/001; B05B 1/002; B05B 15/0208; B05B 15/2058; B08B 3/02
See application file for complete search history.

(56) References Cited

U.S. PATENT DOCUMENTS 2,568,057 A * 9/1951 Cotter ..... B05B 1/3447 222/153.13
3,771,539 A * 11/1973 De Santis ..... B05B 15/0258 134/102.1

(Continued)

FOREIGN PATENT DOCUMENTS

CA 0300248 A1 * 1/1989 ..... B05B 15/0258
CN 2091184 U 12/1991

(Continued)

OTHER PUBLICATIONS

English Translation of Chinese Office Action for Application No. 2011800659653 dated Apr. 28, 2015 (9 pages).

*Primary Examiner* — Michael Jennings
(74) *Attorney, Agent, or Firm* — Bejin Bieneman PLC

(57) ABSTRACT

The invention relates to a cleaning device (1) for an atomizer (2) having a specified outer contour, in particular for cleaning a rotary atomizer (2), comprising at least one cleaning brush (5) for cleaning the atomizer (2), wherein the cleaning brush (5) has a specified brush contour. According to the invention, the brush contour of the cleaning brush (5) is adapted to the outer contour of the atomizer (2) so that the cleaning brush (5) nestles up against the atomizer (2). The invention further relates to a corresponding cleaning brush (5) and to a suitable cleaning method.

21 Claims, 14 Drawing Sheets

Figure 1:
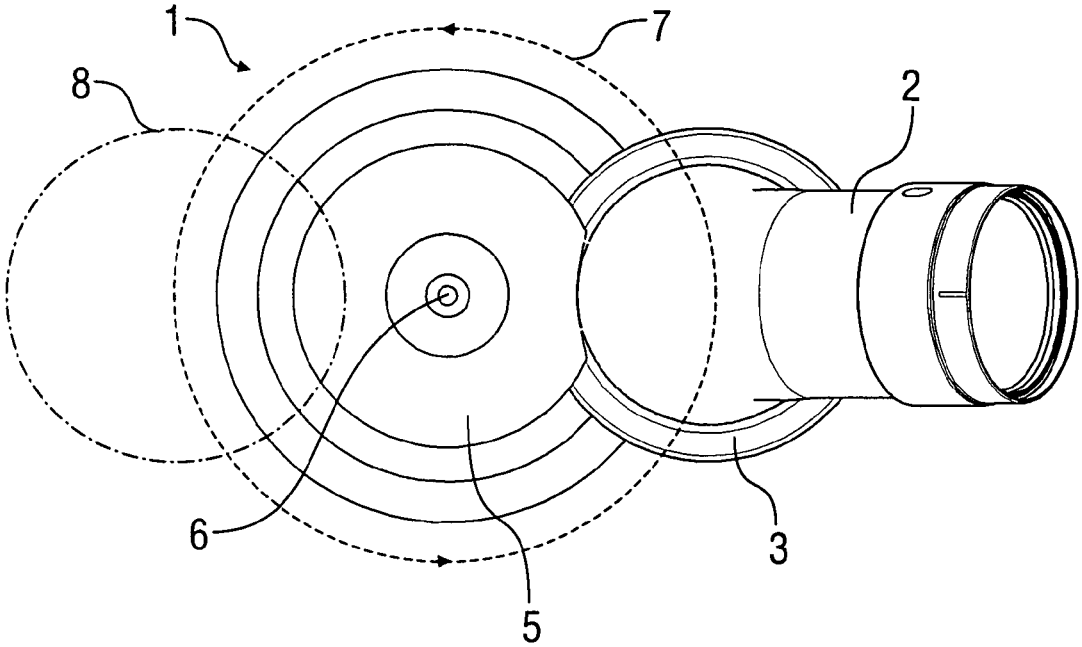

(51) Int. Cl.

| | |
|---|---|
| ***B08B 1/04*** | (2006.01) |
| ***B05B 15/02*** | (2006.01) |
| *B08B 3/02* | (2006.01) |

(56) References Cited

U.S. PATENT DOCUMENTS

| | | | | | |
|---|---|---|---|---|---|
| 3,915,549 | A * | 10/1975 | Amodei | G02F 1/0541 | 359/7 |
| 4,561,145 | A * | 12/1985 | Latham | E01C 23/08 | 15/340.3 |
| 4,785,836 | A * | 11/1988 | Yamamoto | B08B 3/02 | 134/104.1 |
| 5,174,317 | A * | 12/1992 | Robb | B05B 15/0258 | 134/102.2 |
| 5,279,863 | A * | 1/1994 | Escallon | B05B 5/087 | 118/309 |
| 5,314,090 | A * | 5/1994 | Alexander | B05B 7/144 | 222/1 |
| 5,759,271 | A | 6/1998 | Buschor | | |
| 5,769,276 | A * | 6/1998 | Alexander | B05B 3/02 | 222/148 |
| 5,996,855 | A * | 12/1999 | Alexander | B05B 3/02 | 118/621 |
| 6,875,278 | B2 * | 4/2005 | Kerbel | B05B 5/032 | 118/308 |
| 6,899,592 | B1 * | 5/2005 | Kojima | B24B 37/245 | 451/286 |
| 8,567,107 | B1 * | 10/2013 | Bascue | F41A 29/02 | 15/104.16 |
| 2002/0066474 | A1 * | 6/2002 | White | B05B 3/027 | 134/95.2 |
| 2003/0134580 | A1 * | 7/2003 | Sakurai | B08B 1/007 | 451/56 |
| 2005/0066458 | A1 * | 3/2005 | Belcastro | A64B 13/001 | 15/28 |
| 2007/0099426 | A1 * | 5/2007 | Tsujimura | C25F 7/00 | 438/691 |
| 2009/0000646 | A1 * | 1/2009 | Durant | B08B 3/02 | 134/22.11 |
| 2014/0047650 | A1 * | 2/2014 | Hsieh | A47L 17/00 | 15/28 |

FOREIGN PATENT DOCUMENTS

| | | | |
|---|---|---|---|
| CN | 2382489 | Y | 6/2000 |
| DE | 3715969 | A1 | 1/1988 |
| DE | 3915549 | A1 | 11/1990 |
| DE | 102004061322 | A1 | 6/2006 |
| DE | 202007014659 | U1 | 1/2008 |
| DE | 102006039641 | A1 | 2/2008 |
| DE | 102006054622 | A1 | 5/2008 |
| EP | 1327485 | A2 | 7/2003 |
| EP | 1602412 | A1 | 7/2005 |
| EP | 1772671 | A1 | 8/2005 |
| EP | 1671706 | A2 | 6/2006 |
| JP | S60-083090 | U | 6/1985 |
| JP | H10-025710 | A | 1/1998 |
| JP | 2003-275637 | | 9/2003 |
| JP | 2003275637 | A | 9/2003 |
| JP | 2009291912 | A | 12/2009 |
| WO | 2009/056424 | A1 | 3/2009 |

* cited by examiner

CLEANING DEVICE AND CLEANING BRUSH FOR AN ATOMIZER AND CORRESPONDING CLEANING METHOD

The invention relates to a cleaning device for an atomizer, in particular for a rotary atomizer. The invention also relates to a novel cleaning brush for such a cleaning device. Furthermore, the invention also comprises an accordingly adapted cleaning method.

In modern painting installations for painting motor vehicle body parts, rotary atomizers which are guided by multi-axis painting robots are usually used for applying the paint.

In this case there is the problem that the coating agent applied by the rotary atomizer is not deposited fully and exclusively onto the motor vehicle body parts to be painted, but leads with a certain portion ("overspray") to contamination, a certain portion of the overspray also being deposited on the outside of the rotary atomizer. This entails the risk, in particular when changing color, that coating agent of the previously painted color drips from the housing of the rotary atomizer onto the motor vehicle body part to be painted and makes it unusable owing to the associated discoloration.

There is also the risk that the contamination of the rotary atomizer limits its functionality. For example, shaping air bores can become clogged by paint residues and a high voltage system used for electrostatically charging the coating agent can be disrupted by contamination.

Therefore, different types of cleaning devices are known from the prior art, which make it possible to clean a rotary atomizer.

For example, EP 1 671 706 A2 and DE 10 2004 061 322 A1 disclose such a cleaning device, which has a pot-shaped receptacle into which the atomizer is inserted during the cleaning process. The rotary atomizer is then rinsed with a rinsing agent to rinse out any paint residues remaining in the atomizer. The outer contour of the rotary atomizer is however also cleaned by the atomizer being sprayed from the outside with a rinsing agent. Finally, the rotary atomizer can also be dried by blowing air being blown at the atomizer from the outside.

Furthermore, other types of cleaning devices for rotary atomizers are known from the prior art, which use cleaning brushes which brush the outer contour of the rotary atomizer as the cleaning means. Such cleaning devices are however problematic in particular if the rotary atomizer has an external charging ring which projects outwardly from the housing of the rotary atomizer. The known cleaning devices with cleaning brushes can then clean only the front region of the rotary atomizer in front of the external charging ring, whereas cleaning of the external charging ring and the rear region of the rotary atomizer with such cleaning devices has not been possible until now.

Reference is also to be made to DE 39 15 549 A1, JP 2003 275 637 A, DE 37 15 969 A1, DE 10 2006 039 641 A1 and EP 1 327 485 A2 concerning the prior art. However, these documents do not disclose a cleaning device which is based on the brush principle and nevertheless is also capable of cleaning a rotary atomizer having an external charging ring.

The invention is therefore based on the object of creating an improved cleaning device which is based on the brush principle and nevertheless is also capable of cleaning a rotary atomizer having an external charging ring. The invention is also based on the object of creating a correspondingly improved cleaning brush and of specifying a corresponding cleaning method.

These objects are achieved by a cleaning device, a cleaning brush and a cleaning method according to the independent claims.

The invention is based on the general technical teaching of using a special cleaning brush having a brush contour which is adapted to the outer contour of the atomizer and, in the case of an external charging ring, also to the outer contour of the external charging ring, rather than a standard cleaning brush, for cleaning a rotary atomizer having an external charging ring, so that the cleaning brush can brush not only the region of the outer contour of the rotary atomizer in front of the external charging ring, but also the external charging ring itself and the region of the outer contour of the rotary atomizer behind the external charging ring.

The cleaning device according to the invention therefore cleans a cleaning region on the outer contour of the rotary atomizer which preferably also comprises an external charging electrode. The cleaning device according to the invention is particularly advantageously suitable for cleaning a rotary atomizer having an outwardly projecting external charging ring in which the actual charging electrodes are embedded. The invention is however also suitable for cleaning rotary atomizers having an electrostatic external charging system with which individual external charging electrodes project from the rotary atomizer in a finger-like manner. Furthermore, the invention is in principle also suitable for cleaning other atomizer types such as airless atomizers, airmix atomizers, ultrasonic atomizers or rotary-disk atomizers, to name just a few types. It should also be mentioned as a precaution that the invention is not only suitable for atomizers having an electrostatic external charging system, but can also be used for cleaning atomizers with which the coating agent to be applied is electrostatically charged by direct charging.

It has already been mentioned above that the cleaning brush of the cleaning device according to the invention preferably has a brush contour which is adapted to the outer contour of the atomizer to be cleaned. To adapt the cleaning brush to a rotary atomizer having an external charging ring which runs around in an annular manner, projects essentially radially and has embedded charging electrodes, the cleaning brush preferably has an outwardly curved portion or other recess, the shape of which is essentially a negative form of the external charging ring, so that the cleaning brush nestles against the outer contour of the rotary atomizer also in the region of the external charging ring and adjacently thereto. The external charging ring can therefore project into the outwardly curved portion of the cleaning brush during cleaning, so that the cleaning brush lies essentially over its entire length against the outer contour of the rotary atomizer including the external charging ring. This offers the advantage that the cleaning brush cleans the outer contour of the rotary atomizer not only in the region in front of the external charging ring, but within the entire cleaning region, which also comprises the external charging ring and the region behind it.

Different variants are possible within the context of the invention, which are described briefly below; it should be pointed out that other variants are also possible.

Common to all the variants described below of the cleaning device according to the invention is that rotating cleaning brushes are used, which brush the outer contour of the atomizer and thereby clean it.

In a first variant of the invention, the rotating cleaning brush has an essentially rotationally symmetrical brush contour and rotates about a stationary rotation axis, the rotation axis of the cleaning brush being aligned essentially parallel to the spraying axis of the atomizer. The atomizer to be cleaned is therefore arranged next to the cleaning brush during cleaning in such a manner that the cleaning brush nestles against the outer contour of the atomizer and in the process also cleans raised portions (e.g. an external charging ring) and depressed portions in the outer contour, as the brush contour is adapted accordingly. In this first variant of the cleaning device according to the invention, the atomizer executes a circumferential movement around the rotating cleaning brush during cleaning, so that the cleaning brush can clean the outer contour of the atomizer over the entire circumference of the atomizer. The circumferential movement of the atomizer around the rotating cleaning brush is preferably in the opposite direction to the rotary movement of the cleaning brush. In this first variant of the invention, the cleaning device preferably has at least one stationary cleaning nozzle in order to wet the cleaning brush prior to cleaning the atomizer with a cleaning liquid and/or, after cleaning the atomizer, to clean it with the cleaning liquid. The advantage of this variant is the stationary arrangement of the rotating cleaning brush. This has the advantage that the cleaning nozzle can also be arranged in a stationary manner so that complex mechanisms are not necessary to adapt the cleaning nozzle to the respective position of the rotating cleaning brush. The stationary arrangement of the rotating cleaning brush is however also advantageous because no complex mechanisms are necessary to move the cleaning brush.

In a second variant of the invention, however, both the cleaning brush and the atomizer are arranged such that they are stationary and parallel to each other during cleaning, both the cleaning brush and the atomizer executing a rotary movement about their own axes so that the cleaning brush can clean the atomizer over its entire circumference. Here too, the cleaning device preferably has at least one stationary cleaning nozzle in order to wet the cleaning brush and/or the atomizer prior to cleaning the atomizer with a cleaning liquid and/or, after cleaning the atomizer, to clean it/them with the cleaning liquid.

In a third variant of the invention, the atomizer axis is arranged in a stationary manner during cleaning, it being possible for the atomizer to execute a rotary movement about its atomizer axis during cleaning, which is however not strictly necessary. In this variant of the invention, however, the atomizer preferably does not execute any movement at all while being cleaned. The rotating cleaning brush executes a circumferential movement around the fixed rotary atomizer so that the cleaning brush can clean the atomizer over its entire circumference. In this variant of the invention, the rotating atomizer is therefore arranged in a stationary manner, whereas the likewise rotating cleaning brush additionally executes a circumferential movement around the atomizer. The circumferential movement of the cleaning brush around the atomizer to be cleaned can for example be realized by means of a planetary gear mechanism and a pneumatic drive. This would have the advantage that no additional drive would be needed for the rotation of the cleaning brush about its own axis. Otherwise, two separate drives can be used, namely one drive for the rotation of the cleaning brush and another drive for the circumferential movement of the cleaning brush around the atomizer. The advantage of this variant of the invention is the fact that the atomizer to be cleaned is stationary during cleaning, so that the insertion opening of the cleaning device can be smaller.

In a fourth variant of the invention, the cleaning device has a plurality (e.g. three) of rotating cleaning brushes with a rotationally symmetrical brush contour, the cleaning brushes being arranged around the atomizer, in particular equidistantly from each other, during the cleaning process. The individual cleaning brushes each rotate about a stationary rotation axis and generally do not execute a circumferential movement around the atomizer. The atomizer to be cleaned is therefore located centrally between the different rotating cleaning brushes, the atomizer to be cleaned executing a rotary movement of limited angle about its atomizer axis during cleaning so that the cleaning brushes can clean the rotary atomizer over its entire circumference. In an embodiment with three rotating cleaning brushes, the atomizer preferably executes a rotary movement of 120° to ensure that the cleaning brushes can encompass the entire circumference of the atomizer. In this variant, the wetting of the cleaning brushes with the cleaning agent can take place relatively simply by means of stationary nozzles, which can also be used during the subsequent cleaning of the rotating cleaning brushes to wet the cleaning brushes with the cleaning agent. The actual cleaning of the rotating cleaning brushes then takes place by rapid rotation of the cleaning brushes, as a result of which any dirt residues are thrown out of the cleaning brushes. The subsequent drying of the atomizer can take place by means of a blowing air ring. In this variant of the invention too, the atomizer to be cleaned is located in the center during the cleaning process, which allows a relatively small insertion opening in the housing of the cleaning device according to the invention. This in turn favors drying of the atomizer, as the distance between the blowing air ring mentioned at the start and the atomizer housing can be kept small.

In a fifth variant of the invention, however, cleaning brushes are used which rotate about the atomizer axis, the cleaning brushes being arranged at a distance from the atomizer axis and facing the rotation axis so that the cleaning brushes brush the outer contour of the atomizer. In this case the cleaning brushes are preferably arranged on the inner wall of a rotating pot, into which the atomizer is inserted coaxially during the cleaning process so that the pot with the cleaning brushes rotates coaxially to the atomizer to be cleaned. To wet the cleaning brushes with the cleaning agent, for example stationary nozzles can be used, which are attached behind the brushes and spray through between the brushes. Cleaning of the cleaning brushes is however not possible by rapid rotation of the cleaning brushes in this variant, as the centrifugal force would result in any dirt residues being driven deeper into the cleaning brush. A possibility of cleaning the cleaning brushes in this variant of the invention consists in that the complete cleaning device or at least the pot with the cleaning brushes located therein is flooded with a cleaning liquid to allow the cleaning brushes to rotate in a cleaning agent bath. The atomizer can in this case again be dried with the aid of a blowing air ring, it being possible to keep the diameter of the blowing air ring small, which favors drying.

With the pot-shaped cleaning brush mentioned above, the cleaning brush can have an insertion opening on the side, through which the atomizer can be inserted into the pot-shaped cleaning brush transversely to the rotation axis of the cleaning brush. For example, the cleaning brush can to this end consist of a plurality of segments, which are arranged in a distributed manner over the circumference and each leave gaps free between each other, through which the atomizer can be inserted and withdrawn in a radial direction. The lateral insertion/withdrawal of the atomizer has the advantage compared to an axial insertion/withdrawal that no problems with bending bristles or bristle bunches occur. Furthermore, this makes a relatively small design possible.

With a pot-shaped receptacle for the cleaning brush, the problem can arise that the cleaning agent and dirt residues are driven radially outwards owing to the centrifugal forces and then must be somehow discharged. This can be allowed in such a way that the pot-shaped receptacle and/or the cleaning brush have on their circumference at least one opening through which the cleaning agent and/or dirt residues can be discharged outwardly.

To clean the cleaning brush in the different variants of the invention, a plate, a bar, a comb or similar, on which paint particles are knocked or scraped off the brush, can engage in the brush.

The cleaning device according to the invention preferably has a largely closed housing in which the atomizer is cleaned. The atomizer is therefore inserted through an insertion opening into the housing for cleaning, the insertion movement preferably being aligned at right angles to the spraying axis of the atomizer. In this case, on the one hand, it is necessary for the insertion opening to be sufficiently large for the atomizer to be inserted through the insertion opening into the housing. There is however, on the other hand, also a need for an insertion opening which is as small as possible to prevent dirt residues from escaping outwards through the insertion opening from the cleaning device. In a preferred exemplary embodiment of the invention, the insertion opening of the housing therefore has a clear cross section which is essentially a negative form of the outer cross section of the atomizer, a constant gap which is as narrow as possible remaining between the circumferential edge of the insertion opening and the outer contour of the atomizer in order to allow the insertion of the atomizer into the housing.

In another embodiment, the atomizer is inserted coaxially to its spraying axis into the housing of the cleaning device. In this exemplary embodiment, the insertion opening has an outer cross section which is essentially a negative form of the outer cross section of the atomizer at right angles to its spraying axis. Therefore the insertion opening is generally circular in this exemplary embodiment.

There are preferably different stations inside the housing of the cleaning device according to the invention, which stations provide various tasks as part of the whole cleaning process.

Thus, an atomizer internal rinsing station can be located within the housing of the cleaning device according to the invention, in which station the atomizer is rinsed with a rinsing agent in order to rinse out the coating agent remaining in the atomizer.

Furthermore, a brush wetting station is preferably located inside the housing of the cleaning device, in which brush wetting station the cleaning brush is wetted with a cleaning agent in order to improve the cleaning effect during subsequent cleaning.

Furthermore, a cleaning station is located inside the housing of the cleaning device, in which cleaning station the atomizer is cleaned by the cleaning brush by the cleaning brush brushing off the outer contour of the atomizer.

A brush rinsing station is preferably also located inside the housing of the cleaning device, in which brush rinsing station the cleaning brush is cleaned with a rinsing agent in order to remove dirt residues from the cleaning brush.

An atomizer external rinsing station can also be located in the housing of the cleaning device, in which atomizer external rinsing station the atomizer is sprayed with a rinsing or cleaning agent from outside before being brushed off, in order to improve the subsequent cleaning effect.

Finally, a drying station is preferably also located inside the housing of the cleaning device, in which drying station the atomizer is subsequently dried.

The different stations mentioned above can be arranged in a spatially separate manner inside the housing of the cleaning device. However, there is also the possibility that for example the drying station and the atomizer external rinsing station form a common station and therefore are not spatially separate.

In a preferred exemplary embodiment of the invention, three stations which are spatially separate from each other are provided inside the housing, namely an atomizer internal rinsing station, a station for external rinsing of the atomizer and for drying the atomizer and/or a station for cleaning the atomizer, for wetting the cleaning brushes with a cleaning agent and for rinsing the cleaning brush with a rinsing agent.

In the preferred exemplary embodiment of the invention, the atomizer can be moved essentially along a travel path between the atomizer internal rinsing station, the atomizer external rinsing station, the drying station and/or the cleaning station in the housing, the travel path running preferably at right angles to the spraying axis of the atomizer and linearly. It should furthermore be mentioned that the travel path preferably runs horizontally or vertically. The housing of the cleaning device according to the invention therefore preferably has along the travel path a slit-shaped opening through which the atomizer projects outwardly from the housing of the cleaning device when the atomizer is on the travel path within the housing, so that the atomizer can be moved in the housing of the cleaning device by a painting robot located outside the housing. The slit-shaped opening preferably has, transversely with respect to the travel path, a clear width, which is smaller than the clear width of the insertion opening, so that the atomizer can only be inserted into the housing and removed from the housing through the insertion opening, but not through the slit-shaped opening. The only purpose of the slit-shaped opening is therefore that the atomizer can be moved in the housing by a painting robot located outside the housing, whereas the atomizer can only be inserted into the housing and removed therefrom through the insertion opening. In this exemplary embodiment, the cleaning station, the drying station and the atomizer internal rinsing station are arranged one after the other in a straight line along the linear travel path. The atomizer internal rinsing station is in this case preferably located directly behind or under the insertion opening, so that the atomizer reaches the atomizer internal rinsing station immediately after insertion into the housing without the atomizer having to be moved further along the travel path. The drying station is located along the travel path between the cleaning station and the atomizer internal rinsing station, the cleaning station preferably being arranged further away from the insertion opening than the drying station and the atomizer internal rinsing station.

It should furthermore be mentioned that the insertion opening for the atomizer can also be arranged between the cleaning station and the drying station. This makes compact outer dimensions of the cleaning device possible. However, such an arrangement also allows a smaller total travel path.

The drying station preferably has a pivotable stirrup and a stationary stirrup, which each have at least one nozzle for supplying blowing air, wherein the nozzles are oriented towards the atomizer. In this case, a plurality of blowing air nozzles is preferably arranged along the stirrup in order to blow blowing air at the atomizer over the entire length of the stirrup. The stationary stirrup and the pivotable stirrup preferably run essentially perpendicularly and laterally adjacently to the atomizer, the pivotable stirrup preferably being pivotable about a perpendicular pivot axis so that the pivotable stirrup can be pivoted around the atomizer. The pivot axis of the pivotable stirrup in this case preferably coincides with the atomizer axis. Here, it must also be mentioned that the pivotable stirrup is preferably pivoted only by a limited maximum pivoting angle, wherein the possible pivoting angle is between 330° and 270°. The pivotable stirrup and the stationary stirrup allow very efficient drying of the atomizer. To this end, the atomizer is first blown free by the stationary stirrup with the blowing air nozzles located thereon. The pivotable stirrup, which likewise has a plurality of blowing air nozzles, then blows at the atomizer, the pivotable stirrup being pivoted in a first rotation direction with inactive blowing nozzles as far as the end stop and preferably by a rotation angle of less than 180°. The starting position of the pivotable stirrup is preferably the position in which the pivotable stirrup is opposite the stationary stirrup. The pivotable stirrup with the active blowing air nozzles then pivots in the opposite rotation direction by the maximum possible rotation angle as far as the second end stop. This process can be repeated if required. Finally, the pivot angle is then pivoted around the atomizer in the first rotation direction, for example by a rotation angle of 180°.

It should further be mentioned in connection with the pivoting stirrup that the pivoting stirrup can be active from the first movement.

In another exemplary embodiment of the invention, the drying station has two pivoting stirrups which encompass the atomizer laterally during the drying process and can be pivoted about a rotation axis which runs coaxially with the atomizer axis. A plurality of blowing air nozzles is preferably arranged one after the other along the pivoting stirrup on the inner side of the pivoting stirrup, the individual blowing air nozzles being oriented inwardly towards the atomizer. When the two pivoting stirrups rotate about their rotation axis or about the atomizer axis, the blowing air nozzles then blow at the atomizer over its entire circumference and thereby dry it. In this case it is advantageous if a spacing between the two legs of the pivoting stirrup on one side and the outer contour of the atomizer on the other side is as small as possible. Both legs of the pivoting stirrup therefore enclose a clear internal cross section, which preferably forms a negative form of the outer cross section of the atomizer, so that a nearly constant small gap is present between both legs of the pivoting stirrup and the outer contour of the atomizer.

In the cleaning device according to the invention, the atomizer is preferably sprayed before cleaning. To loosen the dirt, wetting/pre-moistening of the dirty surface takes place directly before it is rotated into the brush during the cleaning process. The wetting/moistening is thus preferably part of the cleaning station and not part of a separate station. On the opposite side there is preferably a nozzle arrangement, which rinses or re-rinses the cleaned surface of the atomizer directly after it leaves/is rotated out of the brush engagement region, which is also referred to as "rinsing clean". This nozzle arrangement for rinsing clean is directed towards the atomizer surface in such a manner that the surface of the atomizer is "rinsed clean" (i.e. the last dirt residues and/or diluted dirt are rinsed off) and cleaning agent also reaches the region of brush engagement, so that the cleaning agent is also used for the actual brush cleaning. This offers the advantage that there is not additional rinsing agent consumption. This procedure of using the rinsing agent twice has independent significance worthy of protection. Drying is not combined with a further function in one station but is provided separately.

With respect to the design of the individual blowing air nozzles, there are various possibilities. For instance, the blowing air nozzles can be slit-shaped and have a slit width of 0.1-1 mm and a slit length of 100 mm-300 mm.

Alternatively, however, it is also possible for the blowing air nozzles to have round, preferably circular bores, which can have a bore diameter of 0.1 mm-2.0 mm and a spacing of 1 mm-4 mm.

Preferably, the blowing air nozzles are designed in such a way that the blowing air flows out of the blowing air nozzles with a flow velocity of more than 200 m/s.

The above-mentioned brush rinsing station has the task of cleaning the cleaning brush with a rinsing agent in order to remove any dirt residues from the cleaning brush. The brush rinsing station therefore preferably has a plurality of rinsing nozzles in order to eject the rinsing agent onto the cleaning brush. To this end, more than two rinsing nozzles are preferably provided, it being possible for the individual rinsing nozzles to have a nozzle diameter of 0.4 mm-1.0 mm.

In practice, the nozzle arrangement which is referred to here as the brush rinsing station is also used to moisten the whole brush before first making contact with the atomizer (while the atomizer approaches the cleaning device and cleaning brush) in order to obtain the full cleaning effect from the start. During actual cleaning (when the atomizer is in contact with the cleaning brush), the cleaning device can be inactive. After cleaning, these nozzles can be cleaned together with the above-mentioned parts (plate, bar, comb etc.).

There is also the possibility within the context of the invention for the drying station to have a heating means to heat the blowing air. Furthermore, the drying station can also have an air conditioning means to dry the blowing air, as a result of which the drying effect is further improved. Finally, the drying means can also have a suction means to suck air from the surface of the outer contour of the atomizer and thereby support the drying process. The above-described possibility of heating can also be used for the cleaning agent, which can likewise be heated.

The above-mentioned atomizer internal rinsing station makes it possible to rinse the atomizer with a rinsing agent and rinse any coating agent remaining in the atomizer out of the atomizer, which takes place in particular in the event of a color change or what is known as quick rinsing. The mixture of residual coating agent and rinsing agent which comes out of the atomizer could however likewise result in contamination and is therefore preferably collected in the atomizer internal rinsing station by an essentially tubular or funnel-shaped receptacle, the atomizer being arranged essentially coaxially above or in the receptacle during a rinsing process and spraying the remaining coating agent and rinsing agent into the receptacle, as a result of which contamination of the cleaning device is largely prevented. The funnel-shaped or tubular receptacle is preferably connected to a disposal system in order to dispose of or recycle the remaining coating agent and the rinsing agent.

It should furthermore be mentioned that the invention is not limited to a complete cleaning device for an atomizer. Rather, the invention also comprises a novel cleaning brush which can be used in such a cleaning device and is characterized in that the brush contour of the cleaning brush is adapted to the outer contour of the atomizer, as has already been mentioned above.

For example, the cleaning brush according to the invention may be a multipart brush consisting of a plurality of brush disks, which are rotatable about a common rotation axis and are arranged one above the other along the rotation axis. In this case the cleaning brush preferably comprises between two and ten brush disks.

It should furthermore be mentioned that the cleaning brush preferably has brush fibers having a length of 30 mm-120 mm, the individual brush fibers preferably being combined to form brush bunches which each contain numerous brush fibers, the individual brush bunches preferably having a spacing of 4 mm-10 mm from each other.

Furthermore, the individual brush bunches preferably have a diameter of 2.5 mm-7 mm and the individual brush fibers preferably have a diameter of 0.15 mm-1 mm.

With regard to the cross section of the individual brush fibers, there are various possibilities, the cross section preferably being round, star-shaped, triangular or polygonal.

Furthermore, the individual brush fibers are preferably arranged at a tilt angle with respect to the outer contour of the atomizer to be cleaned, wherein the tilt angle is preferably in the range of 10° to 90°.

During the actual cleaning process, the cleaning brush is pressed lightly against the atomizer, so that the outer contour of the atomizer penetrates the unloaded outer contour of the cleaning brush to a defined penetration depth, which is preferably in the range of from 5 mm-40 mm.

With regard to the material of the individual brush fibers, there are various possibilities, polyamide preferably being used, in particular polyamide 6, polyamide 12 or polyamide 66. In one exemplary embodiment, the brush fibers and/or the base body of the cleaning brush consist of electrically conductive plastic, e.g. conductive polyamide, for explosion prevention reasons. The base body of the cleaning brush can however consist of post-machined, electrically conductive polypropylene (PP).

Furthermore, combinations of various bristle materials, strengths, angles etc. are possible.

In addition, it should also be mentioned that the cleaning brush preferably has a brush base body, in which the individual cleaning fibers are securely clamped, pressed or stuck on.

Finally, the invention also comprises a novel cleaning method, which is characterized in that the outer contour of the atomizer is also cleaned by the cleaning brush in the region of an external charging electrode and behind it.

Furthermore, the following steps are preferably carried out successively in the context of the cleaning method according to the invention:

- rinsing the atomizer with a rinsing agent in order to rinse out remaining coating agent from the atomizer;
- wetting the cleaning brush with a cleaning agent in order to improve the subsequent cleaning effect;
- moistening the atomizer prior to cleaning the atomizer with the cleaning brush;
- cleaning the atomizer by means of the cleaning brush, wherein the cleaning brush brushes off the outer contour of the atomizer;
- rinsing the atomizer outer side to remove last dirt residues;
- drying the atomizer after cleaning, in particular by blowing blowing air at the atomizer;
- cleaning the cleaning brush after cleaning the atomizer, in particular through spraying the cleaning brush with a cleaning liquid.

It should finally be mentioned that additives can also be added to the cleaning agent. Furthermore, the cleaning agent (e.g. solvent, thinner) can also be mixed with pulsed air in order to improve the cleaning effect.

Other advantageous developments of the invention are characterized in the subclaims or are explained in more detail below together with the description of the preferred exemplary embodiments of the invention on the basis of the figures. The figures show as follows:

FIG. 1 a schematic diagram of a cleaning device according to the invention having a cleaning brush which rotates in a stationary manner, wherein the atomizer executes a circumferential movement around the cleaning brush.

Figure 2:
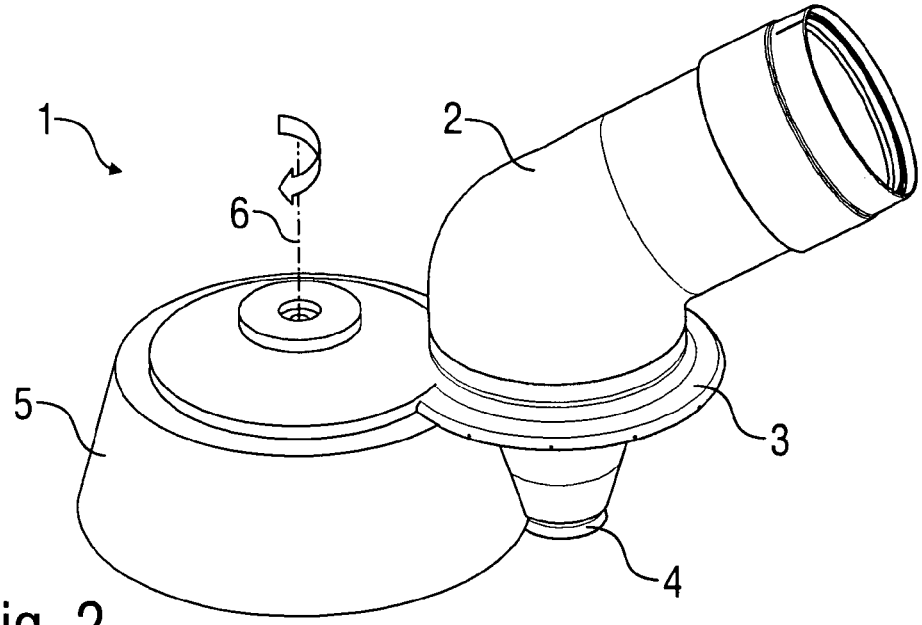

FIG. 2 a perspective representation of the variant according to FIG. 1.

Figure 3:
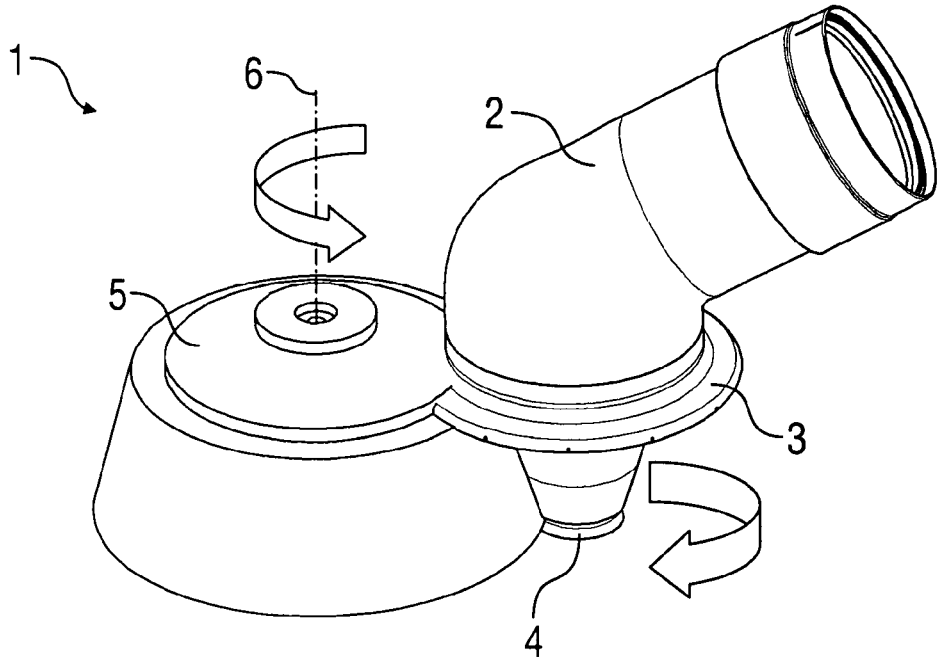

FIG. 3 a schematic perspective representation of another variant of a cleaning device according to the invention, wherein both the cleaning brush and the atomizer each rotate about a stationary rotation axis.

Figure 4:
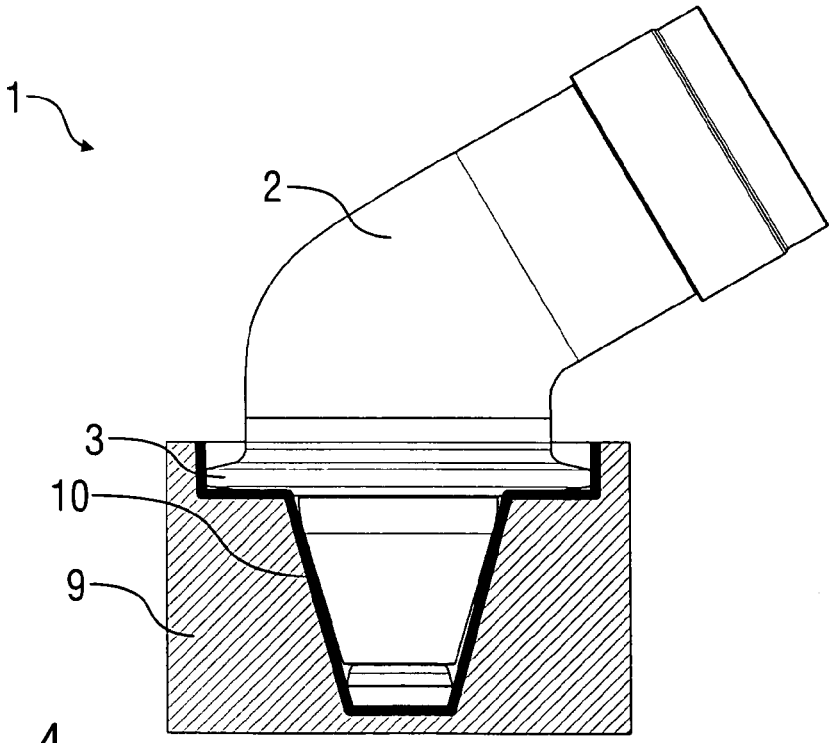

FIG. 4 a cross-sectional view of another variant of a cleaning device according to the invention, having a rotating, pot-shaped receptacle, on the inner sides of which the cleaning brushes are attached, wherein the atomizer is inserted into the pot-shaped receptacle for cleaning.

Figure 5:
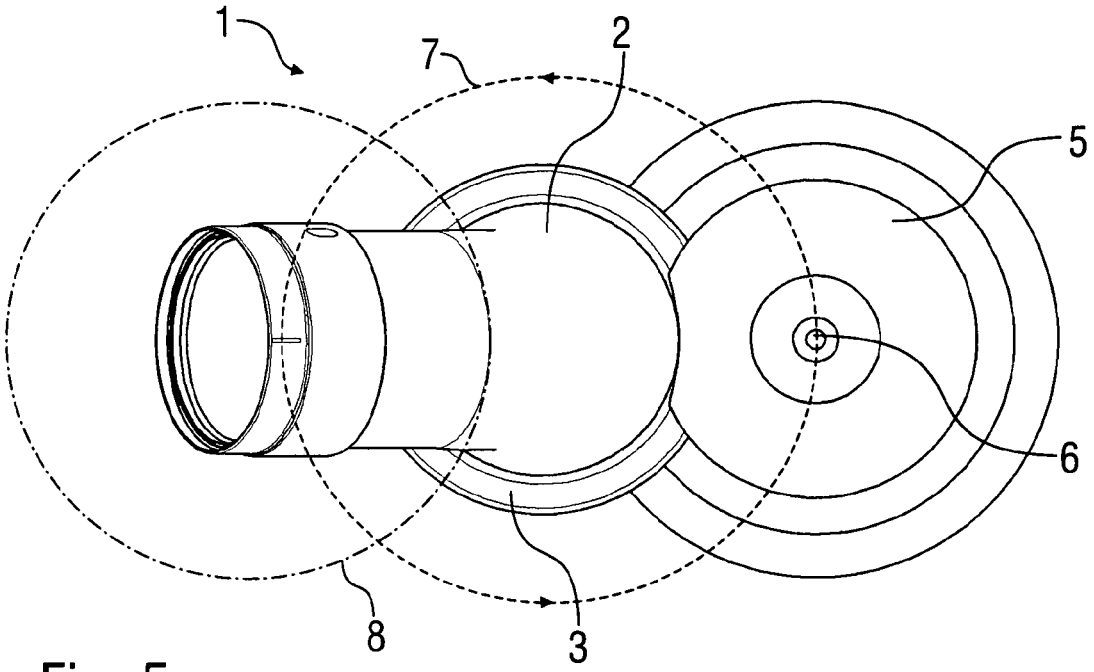

FIG. 5 a schematic diagram of another variant of a cleaning device according to the invention, in which the atomizer rotates about a stationary rotation axis during cleaning, while the likewise rotating cleaning brush executes a circumferential movement around the atomizer.

Figure 6:
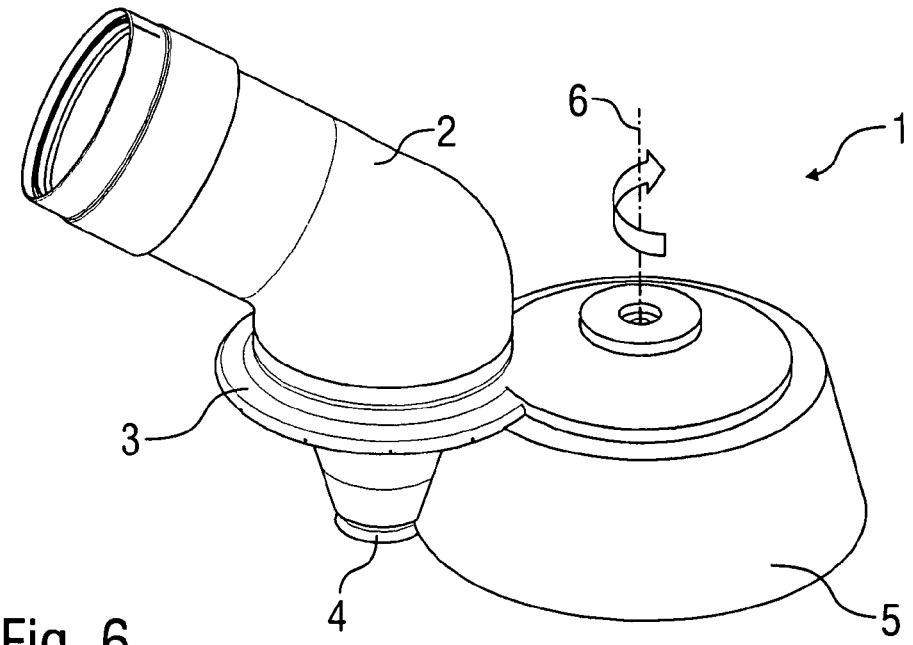

FIG. 6 a perspective view of the variant according to FIG. 5.

Figure 7:
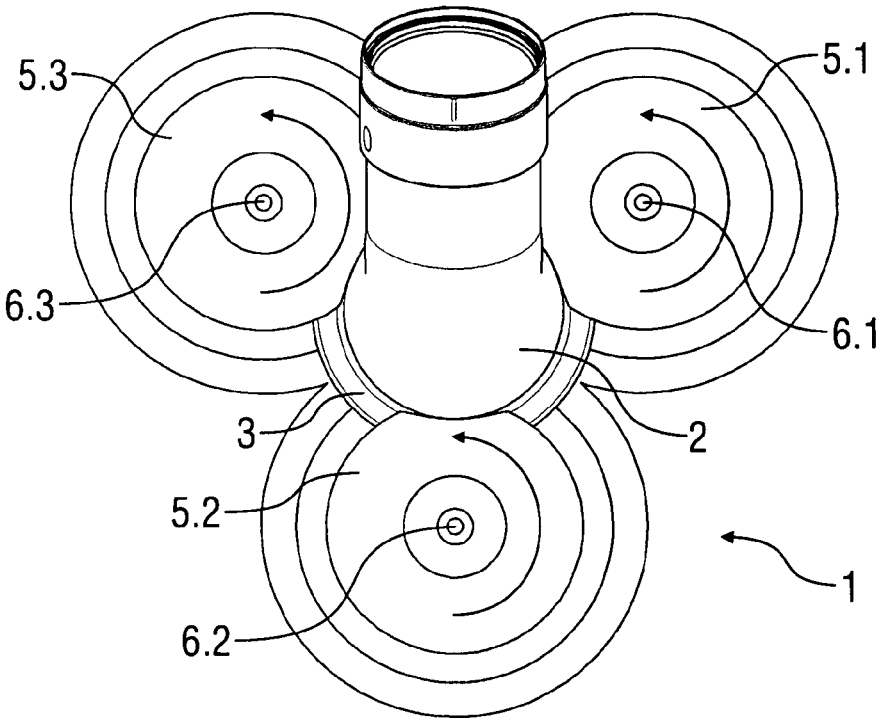

FIG. 7 a schematic diagram of another variant of a cleaning device according to the invention, having three rotating cleaning brushes, which are each arranged in a stationary manner around the atomizer to be cleaned.

Figure 8:
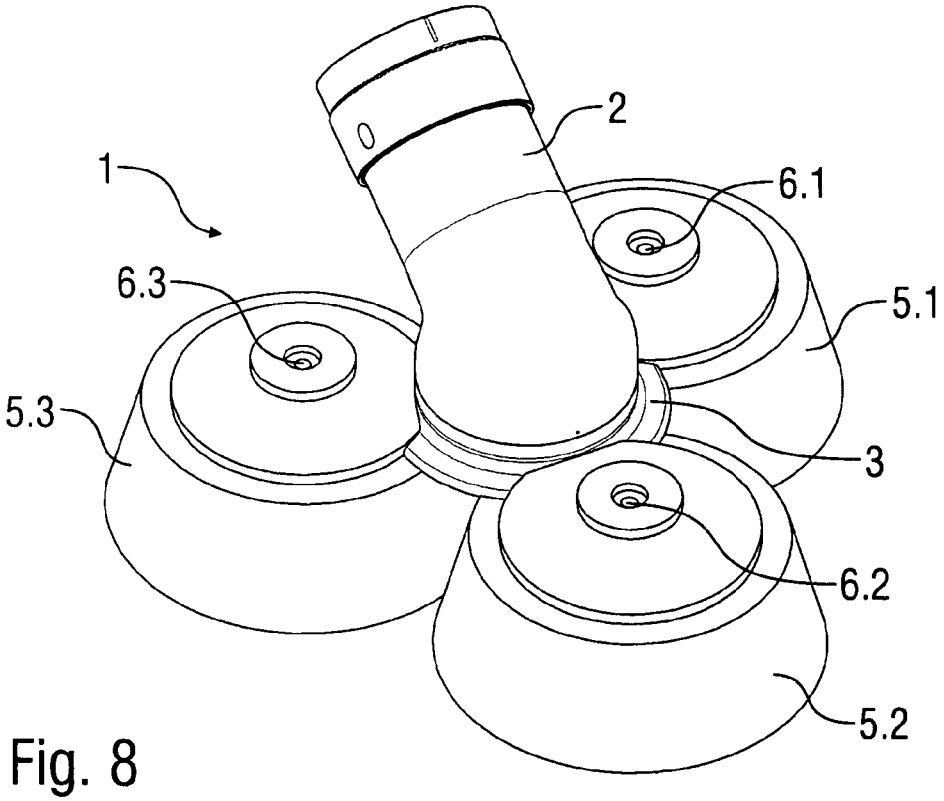

FIG. 8 a perspective view of the variant according to FIG. 7.

Figure 9A:
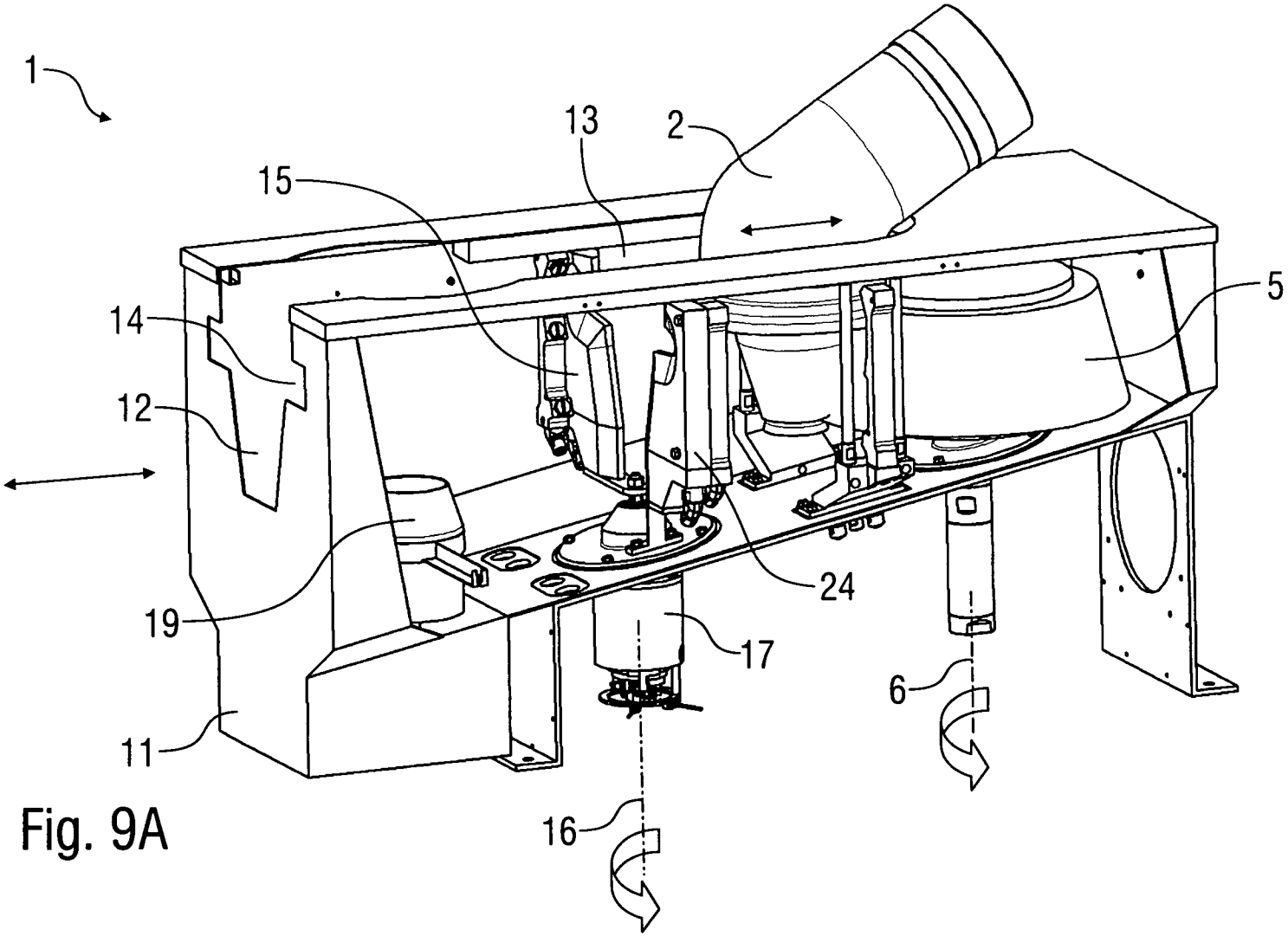
Figure 9B:
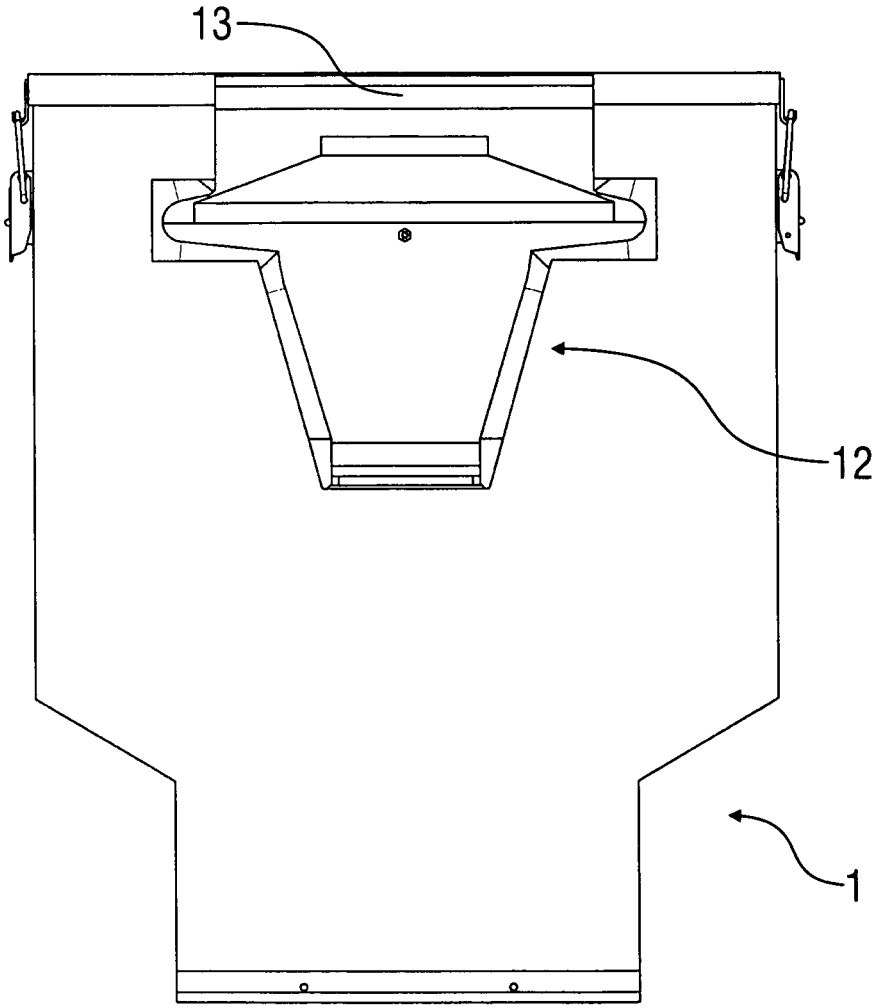

FIGS. 9A-9B various views of a preferred exemplary embodiment of a cleaning device according to the invention, wherein the atomizer to be cleaned is inserted into the cleaning device horizontally.

FIGS. 10A-10G various views of another exemplary embodiment of a cleaning device according to the invention, wherein the atomizer to be cleaned is inserted into the cleaning device vertically.

Figure 11A:
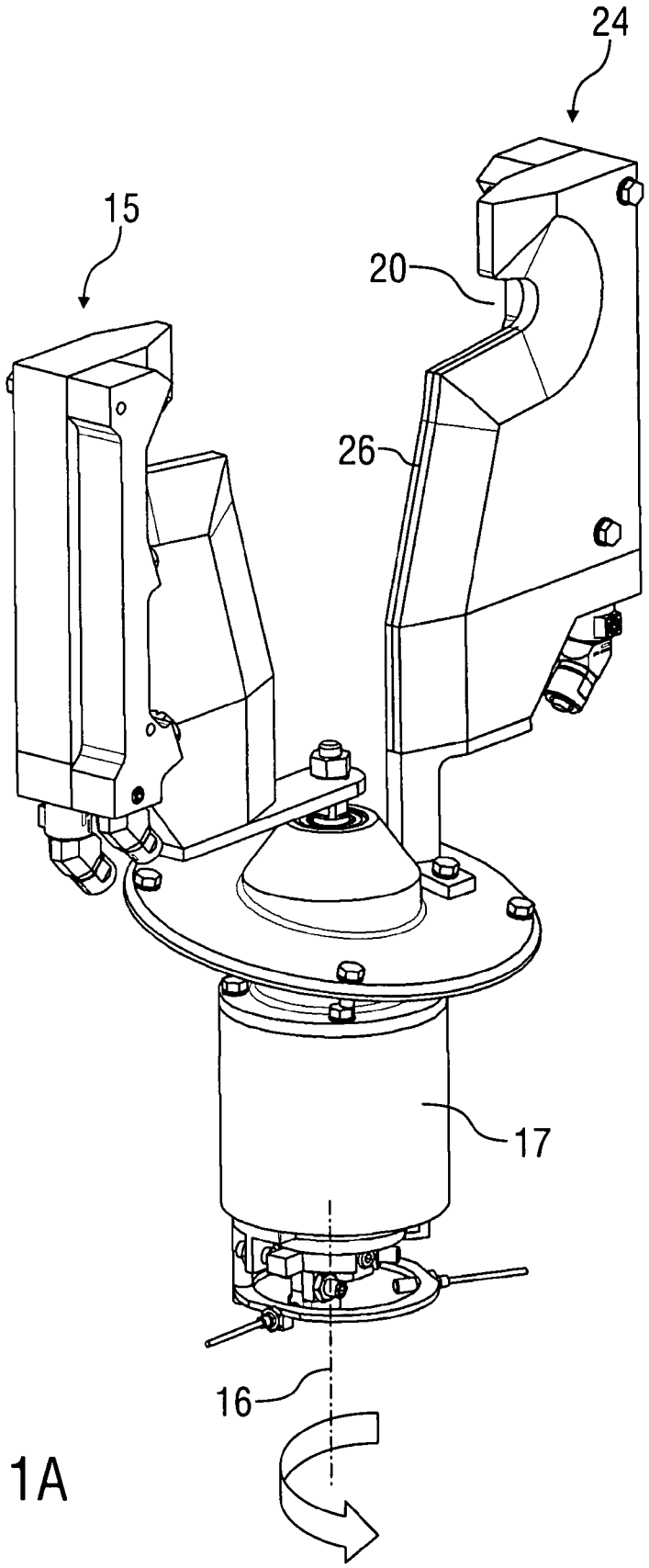
Figure 11B:
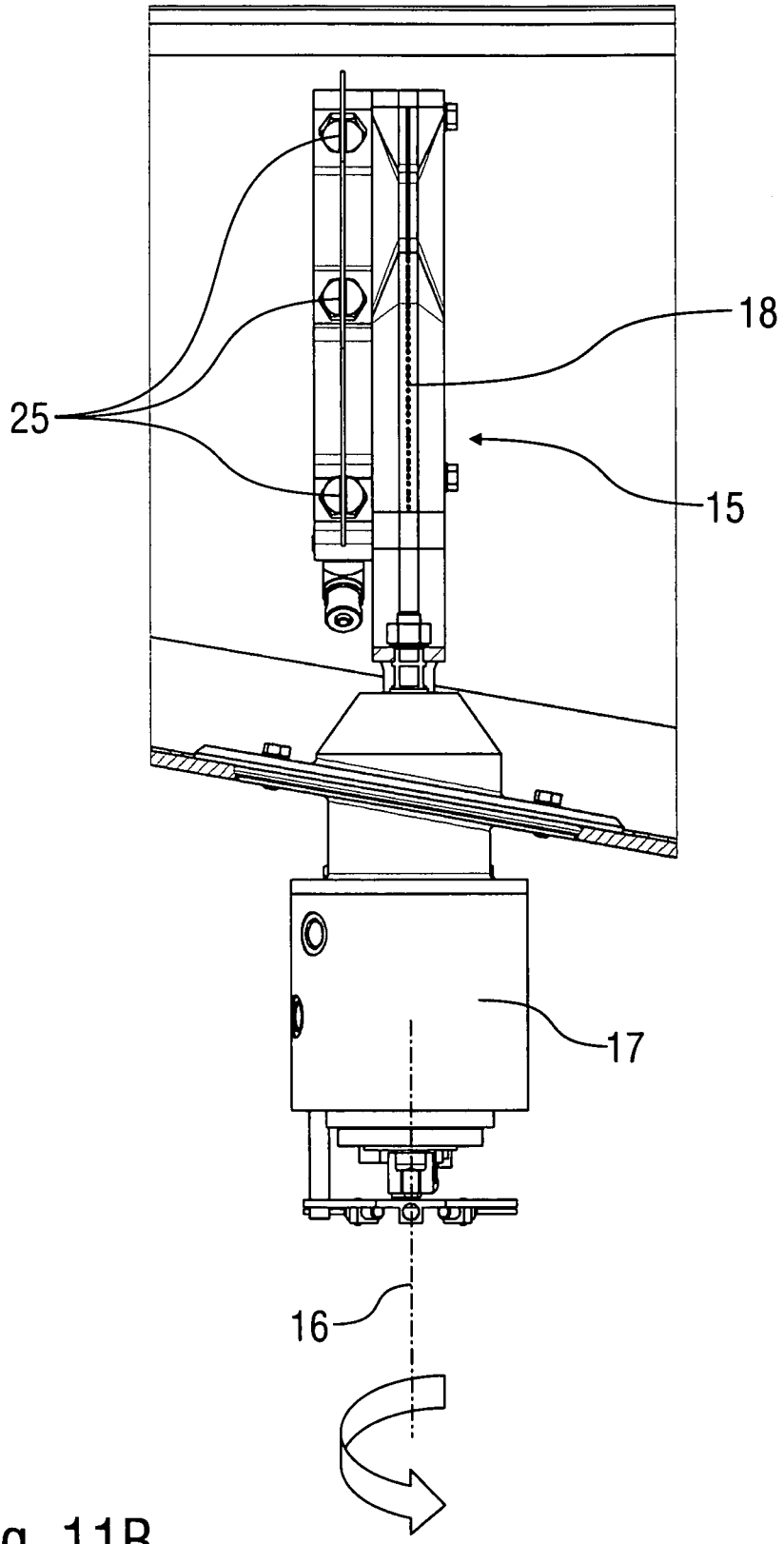
Figure 11C:
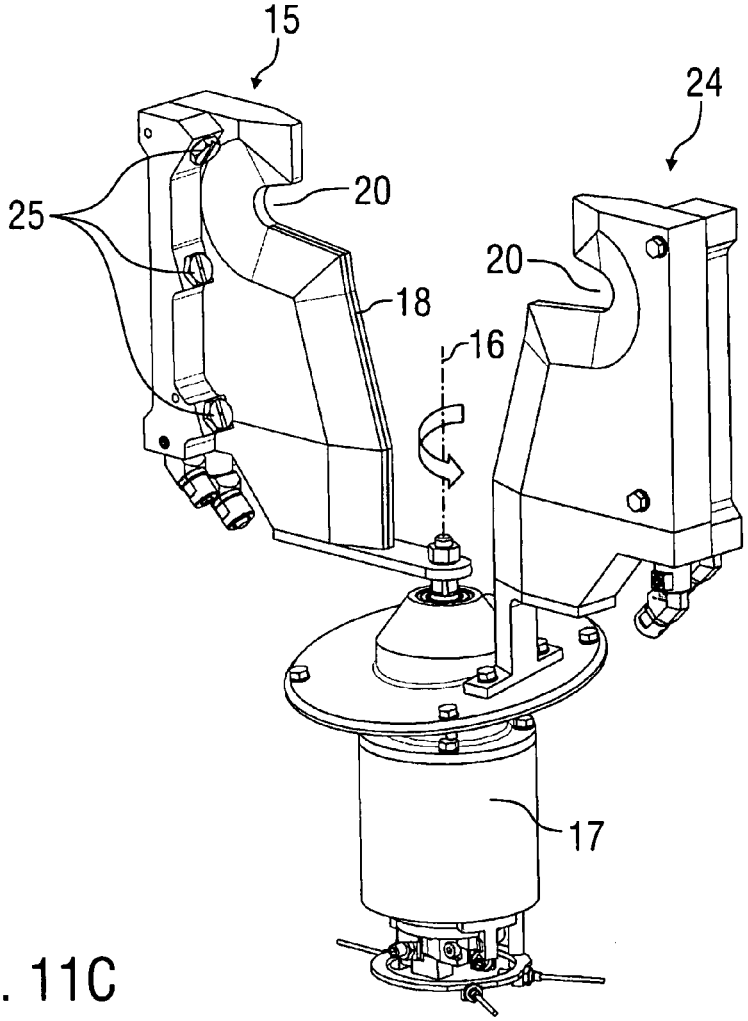

FIGS. 11A-11C various views of a pivoting stirrup which is used in a drying station of the cleaning device according to FIGS. 9A-9B and 10A-10B.

Figure 12:
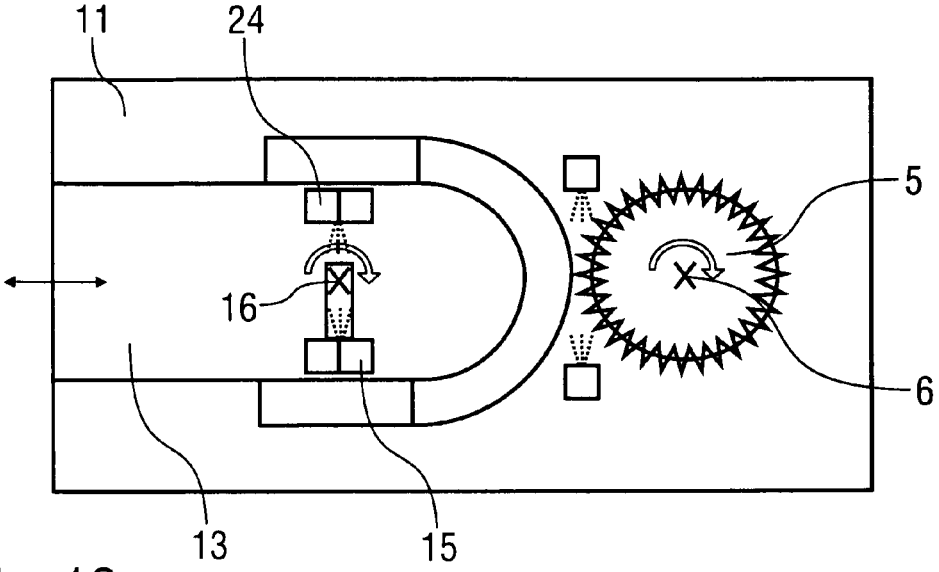

FIG. 12 a schematic diagram of the cleaning device according to the invention, having a stationary blowing air stirrup and a pivotable blowing air stirrup in the drying station.

FIGS. 1 and 2 show, in a very simplified, schematic form, a first variant of a cleaning device 1 according to the invention for cleaning a rotary atomizer 2, which is used for example in a painting installation for painting motor vehicle body parts in order to paint the motor vehicle body parts.

It should be mentioned here that the rotary atomizer 2 has an angled housing, the angled housing part being rotationally symmetrical and bearing an external charging ring 3 in order to electrostatically charge coating agent sprayed by a bell cup 4 of the rotary atomizer 2. The external charging ring 3 contains numerous external charging electrodes distributed over its circumference, which are embedded in the external charging ring 3.

To clean the angled housing part of the rotary atomizer 2, the cleaning device 1 has a cleaning brush 5, which rotates about a stationary rotation axis 6 and is driven by a drive (not represented here). The cleaning brush 5 has a rotationally symmetrical brush contour, which tapers conically upwards in the lower region in FIG. 2 and has an essentially cylindrical brush region in the upper region, the conical brush region and the cylindrical brush region enclosing an inwardly curved portion into which the external charging ring 3 projects during cleaning. The brush contour of the cleaning brush 5 is adapted to the outer contour of the angled housing part of the rotary atomizer 2 in such a manner that the cleaning brush 5 bears against the outer contour of the rotary atomizer 2 within the entire cleaning region of the rotary atomizer 2, including the external charging ring 3. In contrast to the conventional brush-based cleaning devices described at the start, the cleaning brush 5 therefore also cleans the external charging ring 3 and the regions of the angled housing part of the rotary atomizer 2 which border the external charging ring 3.

During the cleaning process, the rotary atomizer 2 is guided around the cleaning brush 5 on a circular path by a conventional painting robot (not represented here), the circumferential movement of the rotary atomizer 2 on the circular path 7 being in the opposite direction to the rotation direction of the cleaning brush 5. On the circular path 7, the rotary atomizer 2 moves out of the position represented into an opposite position 8 indicated with dash-dotted lines and then back into the position shown in FIG. 1.

Owing to the circumferential movement of the rotary atomizer 2 on the circular path 7 around the cleaning brush 5, the cleaning brush 5 cleans the angled housing part of the rotary atomizer 2 over its entire circumference.

The advantage of this variant of the cleaning device 1 according to the invention is the fact that the cleaning brush 5 is arranged in a stationary manner with the rotation axis 6. This has the advantage that the cleaning brush 5 can be wetted with a cleaning agent by a stationary nozzle before cleaning. Furthermore, a cleaning agent can also be applied via this nozzle to the bristles of the cleaning brush 5 in order to clean the cleaning brush 5 again after a cleaning process. This cleaning process of the cleaning brush 5 can be supported by the cleaning brush 5 being rotated rapidly so that the dirt residue adhering to the bristles of the cleaning brush 5 are thrown off owing to the centrifugal force.

FIG. 3 shows another variant of a cleaning device 1 according to the invention, wherein this variant mainly conforms with the variant described above and represented in FIGS. 1 and 2, so that reference is made to the above description to avoid repetitions, wherein the same reference numerals are used for corresponding details.

A special feature of this exemplary embodiment consists in that the rotary atomizer 2 is not moved around the cleaning brush 5 on the circular path 7 during the cleaning process but is stationary. Instead, the rotary atomizer 2 executes a rotary movement about its bell cup axis during the cleaning process, so that the cleaning brush 5 can clean the entire circumference of the angled housing part of the rotary atomizer 2. In this variant, then, both the cleaning brush 5 and the rotary atomizer 2 are arranged in a stationary manner during the cleaning process and each execute rotations about their own axes.

FIG. 4 shows a schematic representation of another variant of a cleaning device 1 according to the invention, wherein this variant of the cleaning device 1 partly conforms with the variants described above, so that reference is made to the above description to avoid repetitions, wherein the same reference numerals are used for corresponding details.

In this variant of the invention, the cleaning device has a pot-shaped receptacle 9, which is arranged coaxially to the angled housing part of the rotary atomizer and to the bell cup axis and rotates about the common axis during the cleaning process, a cleaning brush 10, which runs around the circumference and which brushes off and thereby cleans the outer contour of the angled housing part of the rotary atomizer 2 when the pot-shaped receptacle 9 rotates around the angled housing part of the rotary atomizer 2, being arranged on the inner wall of the pot-shaped receptacle 9.

In this case the cleaning brush 10 likewise has a brush contour which is adapted to the outer contour of the angled housing part of the rotary atomizer 2 including the external charging ring 3, so that the cleaning brush 10 also cleans the region of the external charging ring 3 and the housing regions of the rotary atomizer 2 adjacent to it.

FIGS. 5 and 6 show a modification of the first variant of the cleaning device 1 represented in FIGS. 1 and 2, wherein this variant mainly conforms with the variant described above and represented in FIGS. 1 and 2, so that reference is made to the above description to avoid repetitions.

A special feature of this variant consists in that the rotary atomizer 2 is stationary during the cleaning process, whereas the cleaning brush 5 is moved on the circular path 7 around the rotary atomizer 2, so that the rotating cleaning brush 5 can clean the rotary atomizer 2 over its entire circumference. In this case the cleaning brush 5 therefore executes a planetary movement around the rotary atomizer 2, the cleaning brush 5 at the same time rotating about its own rotation axis 6.

The rotary movement of the cleaning brush 5 about its own axis and the rotary movement of the cleaning brush on the circular path 7 are in this case in opposite directions in order to achieve the best cleaning effect possible. In this variant of the cleaning device 1, the rotary atomizer 2 is stationary during the cleaning process. This has the advantage that the cleaning device can have a relatively small insertion opening for inserting the rotary atomizer 2 into the housing of the cleaning device 1. This favors drying of the rotary atomizer 2 after cleaning, as the gap between the atomizer housing and the blowing air ring can be made much smaller.

The circular movement of the cleaning brush 5 around the rotary atomizer 2 can for example be realized by means of a planetary gear mechanism and a pneumatic drive. This has the additional advantage that no additional drive is needed for the rotation of the cleaning brush 5 about its own rotation axis 6.

FIGS. 7 and 8 show another variant of a cleaning device 1 according to the invention, wherein this variant again partly conforms with the variants described above, so that reference is made to the above description to avoid repetitions, wherein the same reference numerals will be used for corresponding details.

A special feature of this variant consists firstly in that the cleaning device has three cleaning brushes 5.1, 5.2, 5.3, which are arranged equidistantly around the rotary atomizer 2, the cleaning brushes 5.1, 5.2, 5.3 each rotating around stationary rotation axes 6.1, 6.2, 6.3.

The individual cleaning brushes 5.1, 5.2, 5.3 however each cover only part of the circumference of the housing of the rotary atomizer 2 and cannot therefore clean the rotary atomizer 2 over its entire circumference.

During the cleaning process, the rotary atomizer 2 therefore also executes a rotary movement about its bell cup axis, the rotary atomizer 2 covering a rotation angle of at least 120°. The rotation angle covered can however also be smaller (e.g.) 90°), as the three cleaning brushes 5.1, 5.2, 5.3 are engaged at the circumference not only in a linear manner. In a modification of this variant with more than three cleaning brushes 5.1-5.3, the rotation angle covered can be even smaller. In this manner it is ensured that the cleaning brushes 5.1, 5.2, 5.3 can clean the entire circumference of the rotary atomizer 2.

The subsequent cleaning of the cleaning brushes 5.1, 5.2, 5.3 takes place as in the above-described other variants of the invention by wetting the cleaning brushes 5.1, 5.2, 5.3 with subsequent rapid rotation of the cleaning brushes 5.1, 5.2, 5.3 so that dirt residues are thrown out of the cleaning brushes 5.1, 5.2, 5.3 by the centrifugal force.

The subsequent drying of the rotary atomizer 2 functions in this case too by means of a blowing air ring, which is not represented for the sake of simplicity.

Because the rotary atomizer 2 is in the center in this variant of the invention too, the insertion opening can be made correspondingly small, which favors drying, as the distance between the blowing air ring and the atomizer housing can be kept correspondingly small.

FIGS. 9A and 9B show schematic diagrams of a cleaning device according to the invention corresponding to the above-described variant represented in FIG. 3, in which both the rotary atomizer 2 and the cleaning brush 5 each rotate about stationary rotation axes during the cleaning process.

In this case the cleaning device 1 has a housing 11 which contains an insertion opening in the end face on the left in the drawing. The rotary atomizer 2 is therefore inserted into the housing 11 of the cleaning device 1 through the insertion opening 12 in the direction of the double arrow by a conventional, multi-axis painting robot (not represented here) for cleaning.

The housing 11 has a slit-shaped opening 13 on its upper side located at the top in the drawing, through which opening the proximal housing part of the rotary atomizer 2 projects so that the rotary atomizer 2 can be guided in the arrow direction in the housing 11 by the painting robot.

The insertion opening 12 has a clear cross section which is adapted to the outer cross section of the angled housing part of the rotary atomizer 2 and forms virtually a negative form of the outer cross section of the rotary atomizer 2. The insertion opening 12 therefore has two opposite recesses 14 for the external charging ring 3, so when the rotary atomizer 2 is inserted into the insertion opening 12 only a small gap remains between the edge of the insertion opening 12 and the outer contour of the rotary atomizer 2.

In the housing 11 behind the insertion opening 12 there is first an atomizer internal rinsing station to rinse the rotary atomizer 2 with a rinsing agent at the start of a cleaning process, as a result of which any remaining coating agent is rinsed out of the rotary atomizer 2.

The atomizer internal rinsing station comprises an essentially tubular receptacle 19, which is connected to a disposal system (not represented here) to dispose of rinsing agent and coating agent residues. In the event of a paint change or quick rinse, the rotary atomizer 2 is positioned over the tubular receptacle 19 in such a manner that the rotary atomizer 2 sprays coating agent residues and rinsing agent into the tubular receptacle 19.

Behind the atomizer internal rinsing station there is a further station which has several functions.

In the station located behind the atomizer internal rinsing station 12, firstly the outer contour of the atomizer 2 is wetted with a cleaning agent in order to make the subsequent cleaning by the cleaning brush 5 more effective.

However, drying of the atomizer 2 after cleaning by the cleaning brush 5 also takes place in the station behind the atomizer internal rinsing station. To this end, the drying and wetting station has a pivoting stirrup 15, which can be pivoted about a perpendicular pivot axis 16 by a pivot drive 17, which is only represented schematically here. Furthermore, the drying and wetting station also has a stationary stirrup. Furthermore, the two stirrups contain numerous slit-shaped blowing air nozzles on their inner side in order to blow blowing air at the rotary atomizer 2 and thereby dry it. The two stirrups however also contain numerous rinsing agent nozzles in order to spray the atomizer with a rinsing agent from the outside.

Finally, the cleaning device also has the cleaning brush 5, which rotates about its rotation axis 6 and thereby cleans the outer contour of the rotary atomizer 2. In this case too, the brush contour of the cleaning brush 5 is adapted to the outer contour of the rotary atomizer 2 and therefore has a depression in its lateral surface, into which the external charging ring 3 can project.

FIGS. 10A-10G show a modification of the cleaning device according to FIG. 1, so that reference is made to the above description to avoid repetition, wherein the same reference numerals are used for corresponding details.

A special feature of this exemplary embodiment consists in that the insertion opening 12 is arranged on the upper side of the housing 11, so that the rotary atomizer 2 is inserted into and removed from the housing 11 through the insertion opening 12 in the vertical direction.

However, the rotary atomizer 2 is then moved inside the housing in the horizontal direction, as has already been described above. On the upper side of the housing 11 there is therefore likewise the slit-shaped opening 13, through which the rotary atomizer 2 projects upwards so that the rotary atomizer 2 can be moved inside the housing 11 by a painting robot located outside the housing 11.

A further special feature of this exemplary embodiment consists in that the tubular receptacle 19 of the atomizer internal rinsing station is arranged directly under the insertion opening 12. After the rotary atomizer 2 has been inserted through the insertion opening 12 into the housing 11, the rotary atomizer 2 is therefore located directly above the tubular receptacle 19, so that the rotary atomizer 2 can be rinsed immediately.

Figure 10B:
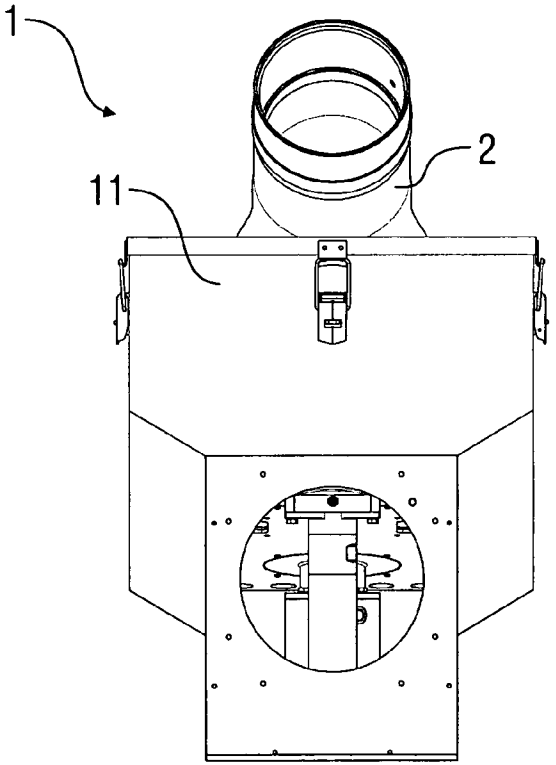
Figure 10A:
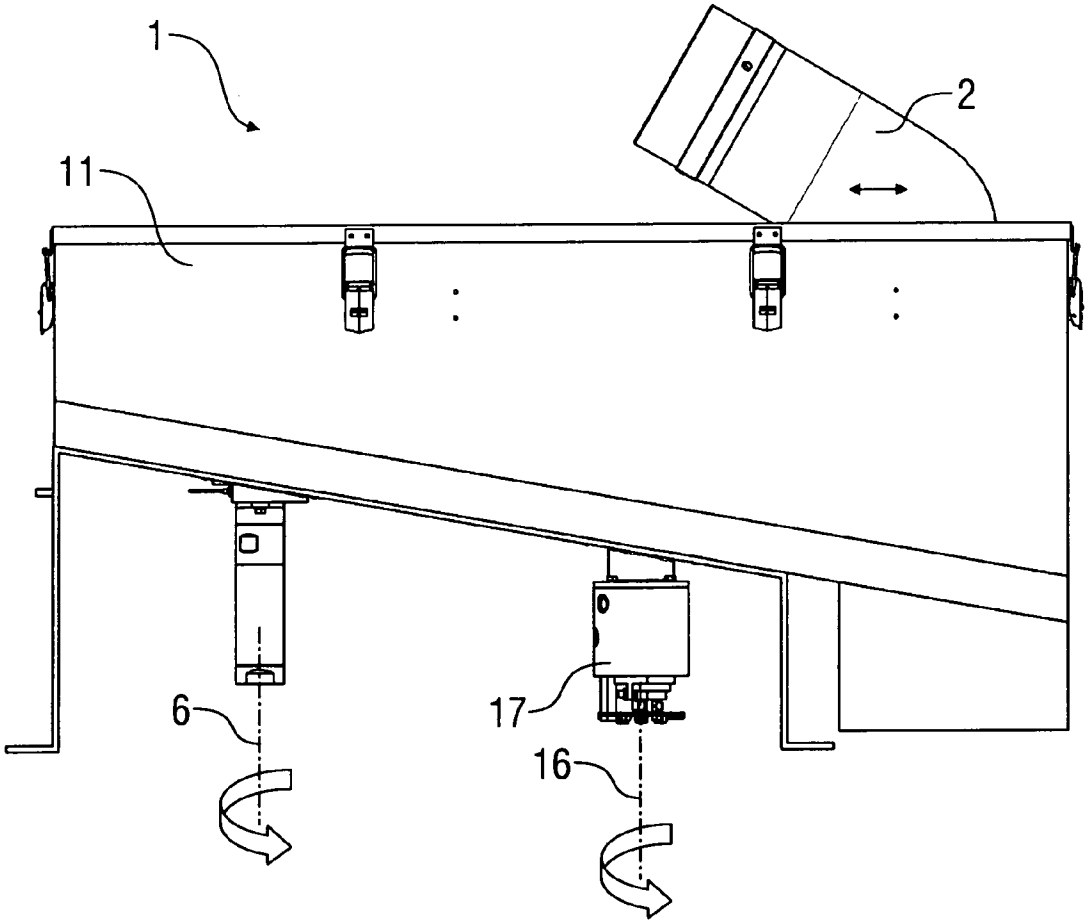
Figure 10C:
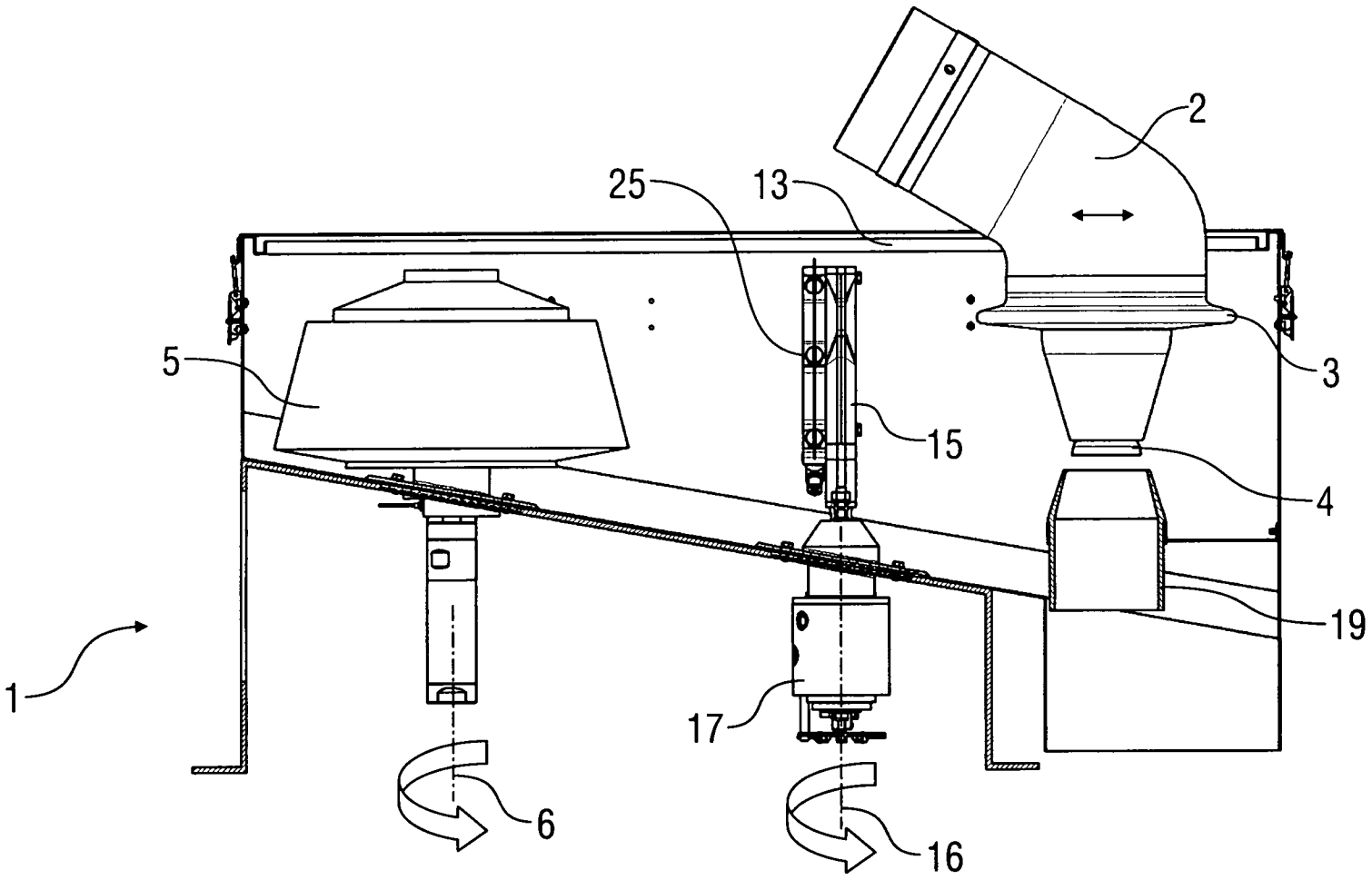
Figure 10D:
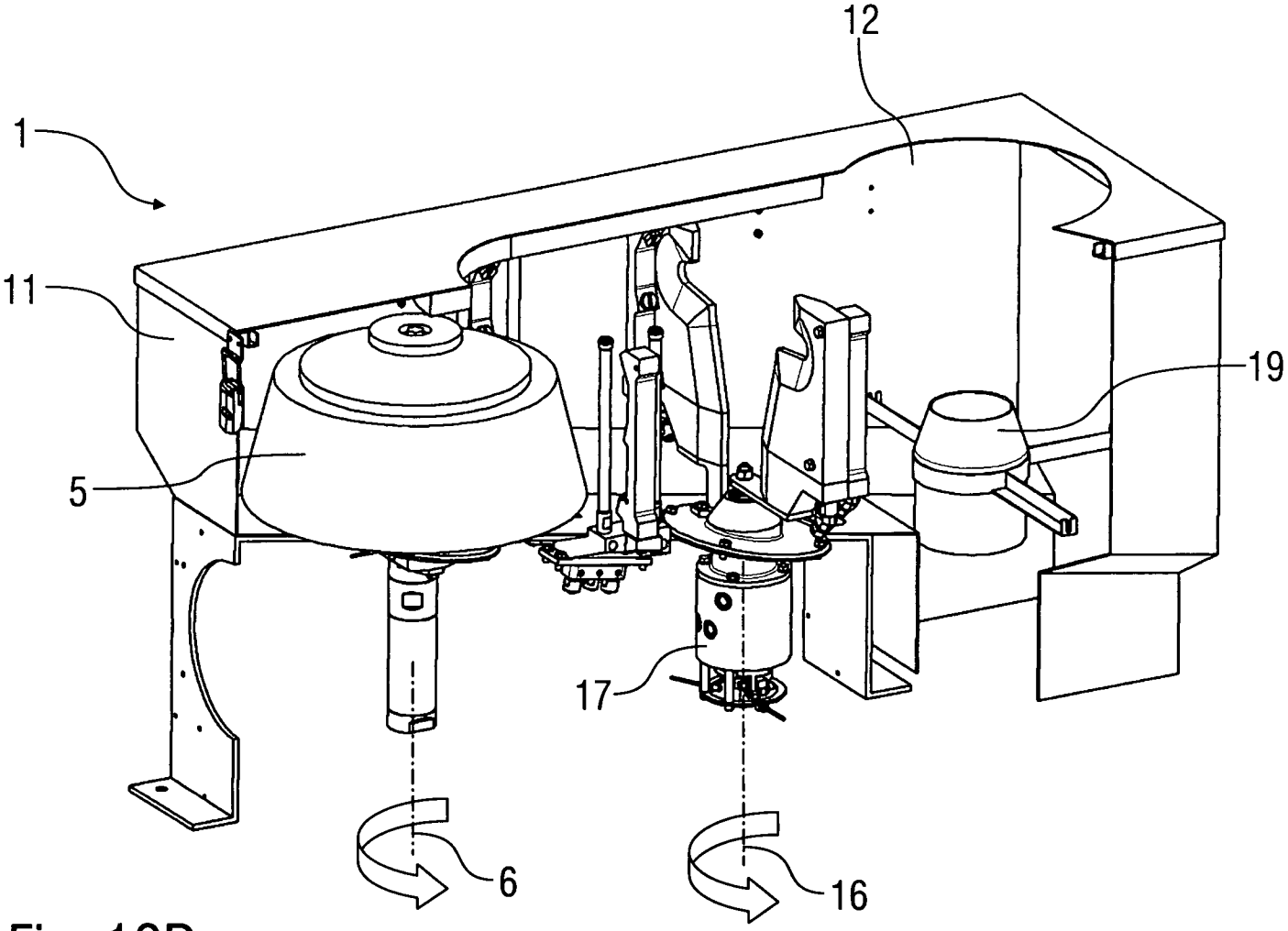
Figure 10E:
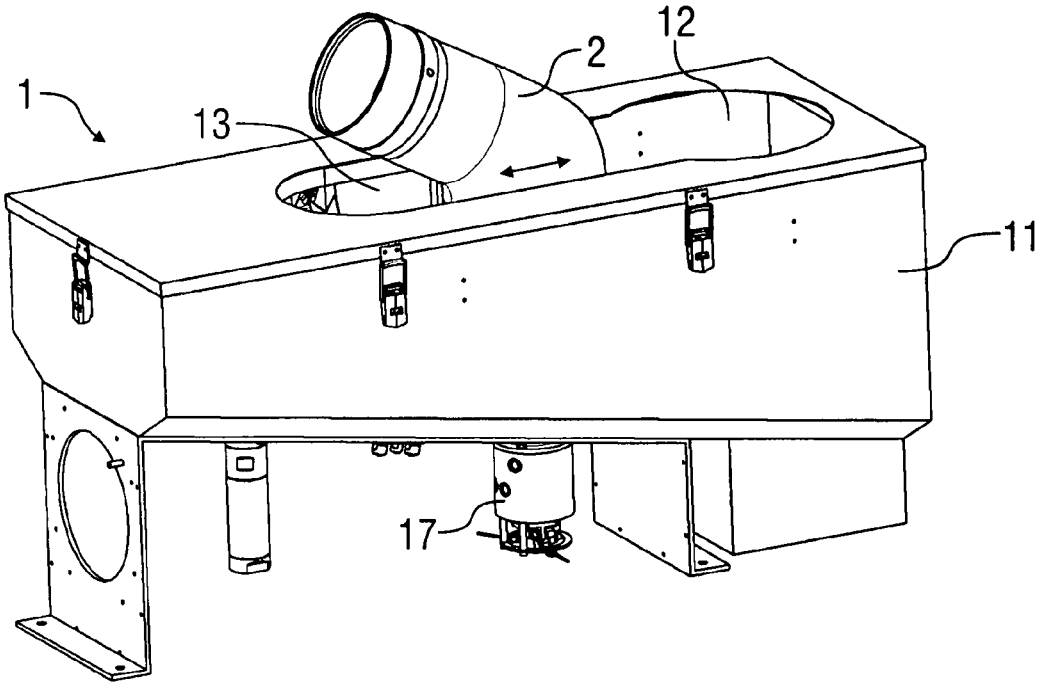
Figure 10F:
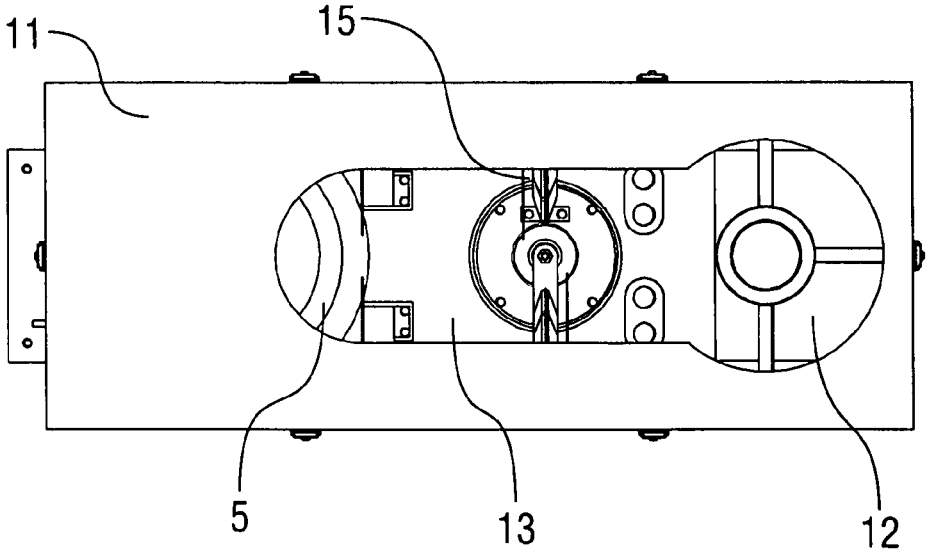
Figure 10G:
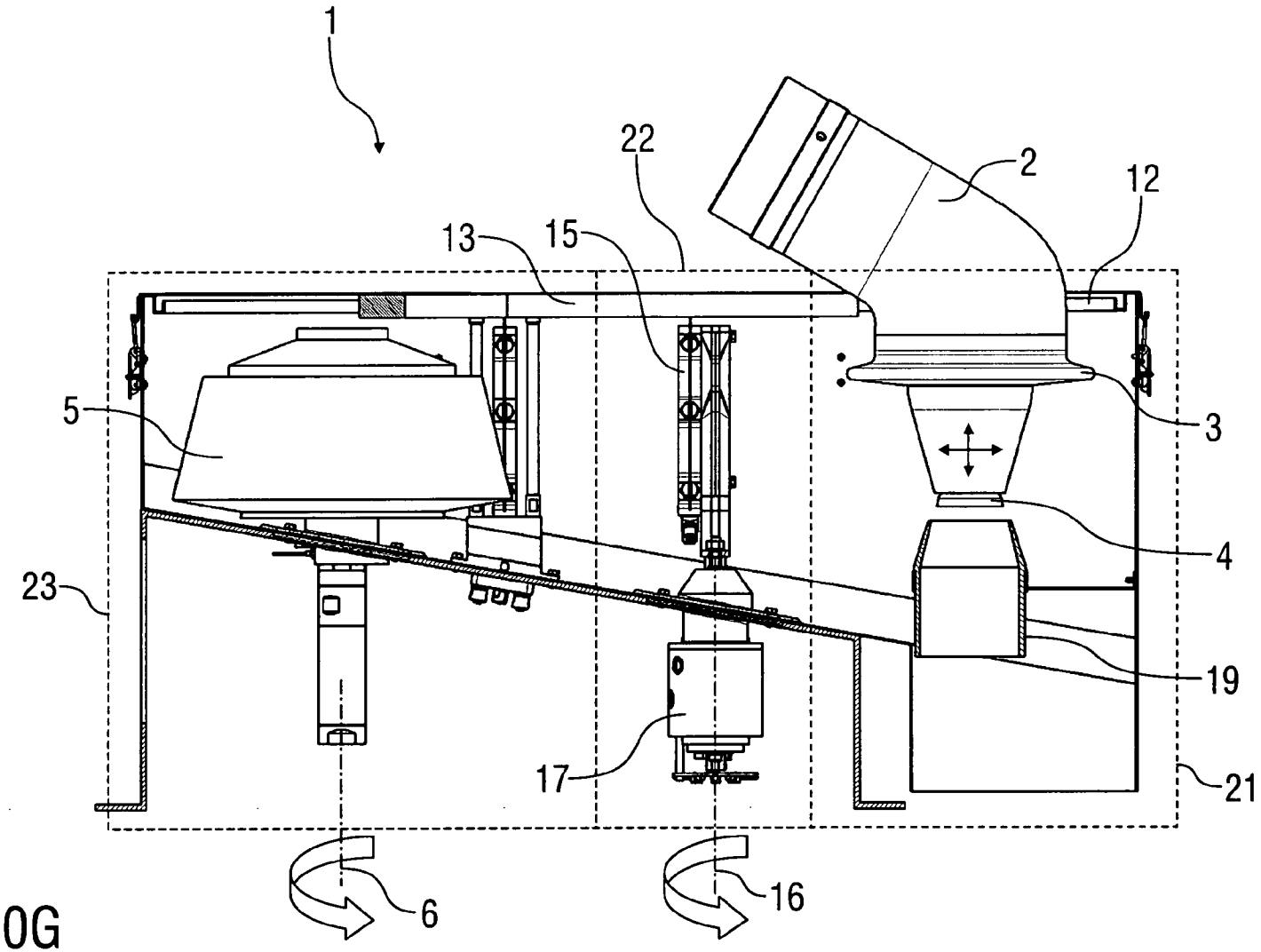

A possible division of the cleaning device 1 inside the housing 11 is described below with reference to FIG. 10G.

In this case, an atomizer internal rinsing station 21, which is represented here with a dashed border, is located on the far right in the housing 11. In the atomizer internal rinsing station 21, the rotary atomizer 2 can be rinsed, the residues of the rinsed out coating agents and the rinsing agent being sprayed into the tubular receptacle 19.

To the left of the atomizer internal rinsing station 21 there is a drying station 22, which has the task of drying the rotary atomizer 2 after cleaning. To this end, the drying station 22 has the above-described pivoting stirrup 15 with the blowing air nozzles 18 located therein.

Furthermore, the atomizer 2 is also sprayed from outside with a cleaning agent in the drying station in order to improve the cleaning effect during the subsequent brushing off of the rotary atomizer 2.

On the far left in the drawing there is finally a cleaning station 23 in which the cleaning brush 5 cleans the outer contour of the rotary atomizer 2, as has already been described above in detail.

FIGS. 11A-11C show different diagrams of the station which serves the cleaning device according to FIGS. 9A-9B and 10A-10G as a drying station 22 and atomizer external rinsing station. In this station, the rotary atomizer 2 is therefore sprayed with a cleaning agent from the outside before brushing off in the cleaning station and dried by blowing with blowing air after brushing off.

To this end, the station has the above-mentioned pivoting stirrups 15, which can be pivoted about a perpendicular pivot axis by the pivot drive 17 in order to be able to spray the rotary atomizer 2 with cleaning agent over its entire circumference and to blow blowing air at it.

The pivoting stirrup 15 has inwardly pointing slit-shaped blowing air nozzles 18 and a plurality of cleaning agent nozzles 25, via which the cleaning agent and blowing air are output onto the outer contour of the rotary atomizer 2.

It should furthermore be mentioned that the pivoting stirrup 15 is adapted with its inner contour to the outer contour of the rotary atomizer 2, so that the inner contour of the pivoting stirrup 15 virtually forms a negative form of the outer contour of the rotary atomizer 2.

Furthermore, this station has a stationary blowing air strip 24, which likewise has slit-shaped blowing air nozzles 26 and cleaning agent nozzles which point inwards towards the rotary atomizer 2.

In each case a recess 20 is arranged in the pivoting stirrup 15 and in the blowing air strip 24, into which recess the external charging ring 3 of the rotary atomizer 2 can project during operation.

FIG. 12 finally shows a schematic representation of the cleaning devices 1 according to the invention described above, wherein this modification mostly conforms with the variants described above, so that reference is made to the above description to avoid repetitions, wherein the same reference numerals are used for corresponding details.

The invention is not limited to the preferred exemplary embodiments described above. Instead, a plurality of variants and modifications are possible, which also make use of the concept of the invention and thus fall within the scope of protection. Furthermore, the invention also claims protection for the subject matter and the features of the subclaims independently of the features of the claims to which they refer.

The invention claimed is:

1. A cleaning system for an atomizer with a predetermined outer contour, comprising:

a cleaning station;

at least one cleaning brush at the cleaning station for cleaning the atomizer, the cleaning brush is adapted to the atomizer, so that the cleaning brush nestles against the atomizer during cleaning;

a drying station arranged to dry the atomizer;

an atomizer internal rinsing station arranged to rinse out coating agent remaining in the atomizer;

an atomizer external rinsing station arranged to spray rinsing agent at an external surface of the atomizer;

a brush wetting station arranged to wet the cleaning brush with a cleaning agent; and a brush rinsing station arranged to clean the cleaning brush; wherein at least one of the drying station and the atomizer external rinsing station include a pivotable stirrup and a stationary stirrup, which each have at least one nozzle, wherein the nozzle is oriented toward a space provided for the atomizer; and the stationary stirrup and the pivotable stirrup run essentially vertical and sidewards near the atomizer space.

2. The cleaning system of according to claim 1, wherein:

the cleaning brush includes at least one recess adapted to an external charging electrode of the atomizer which serves for electrostatic charging of the coating agent to be applied, so that the external charging electrode is cleaned by the cleaning device.

3. The cleaning system according to claim 1, wherein:

the cleaning brush has an outwardly curved portion adapted to an external charging ring of the atomizer, so that the cleaning brush also nestles against the atomizer on and near the external charging ring.

4. The cleaning system according to claim 1, wherein:

the cleaning brush is rotatably mounted and driven about a stationary rotation axis; and the brush contour of the cleaning brush is essentially rotationally symmetrical with respect to the rotation axis.

5. The cleaning according to claim 4, wherein the cleaning device has at least one stationary cleaning nozzle arranged to wet at least one of the cleaning brush and the atomizer with a cleaning liquid.

6. The cleaning system according to claim 1, further comprising:

a housing, wherein:

the housing has an insertion opening in order to insert the atomizer at right angles with respect to a spraying axis into the housing; and the insertion opening is adapted to accept the atomizer.

7. The cleaning system according to claim 1, further comprising:

a housing, wherein:

the housing has an insertion opening in order to insert the atomizer coaxially with respect to a spraying axis into the housing; and the insertion opening is adapated to accept the atomizer.

8. The cleaning system according to claim 1, wherein:

at least one of the drying station and the atomizer external rinsing station form a common station.

9. The cleaning system according to claim 8 wherein:

the pivotable stirrup is pivotable about a vertical pivot axis;

the pivot axis is arranged centrally; and the pivotable stirrup is pivotable by a maximum pivoting angle, which is between 330° and 270°.

10. The cleaning system according to claim 9, further comprising:

a housing;

an insertion opening in the housing;

a travel path that runs linearly through the cleaning station, the drying station, and the atomizer internal rinsing station;

a travel path opening connected to the insertion opening in the housing that runs parallel to the travel path, wherein the travel path opening has a width that is smaller than the width of the insertion opening, so that the atomizer can only be inserted into the housing and removed from the housing through the insertion opening, but not through the travel path opening;

the atomizer internal rinsing station is arranged directly at the insertion opening, so that the atomizer reaches the atomizer internal rinsing station after insertion into the housing without the need to displace the atomizer along the travel path;

the drying station is arranged between the cleaning station and the atomizer internal rinsing station;

the cleaning station is arranged at a greater distance from the insertion opening than the drying station and the atomizer internal rinsing station.

11. The cleaning system according to claim 1, wherein:
the pivoting stirrup has two opposite legs, which encompass the atomizer during the cleaning process;
on each of the two opposite legs of the pivoting stirrup, at least one inwards oriented blowing air nozzle is arranged, respectively, so that the atomizer is blown with the blowing air from opposing sides; and
the two opposite legs define a space that is adapted to receive the atomizer.

12. The cleaning system according to claim 11, wherein:
the blowing air nozzles are slit-shaped;
the slit-shaped blowing air nozzles have a slit width of 0.1 millimeter to 1 millimeter;
the slit-shaped blowing air nozzles have a slit length of 100 millimeters to 300 millimeters;
the individual blowing air nozzles have round bore holes;
the round bore holes have a bore diameter of 0.1 millimeter to 2.0 millimeters;
the adjacent bore holes are spaced apart by 1 millimeter to 4 millimeters from one another;
the blowing air flows out of the blowing air nozzles with a flow velocity of more than 200 meters per second.

13. The cleaning system according to claim 1, wherein:
the brush rinsing station has a plurality of rinsing nozzles arranged to discharge the rinsing agent; and
the individual rinsing nozzles have a nozzle cross-section of 0.4 millimeter to 1.0 millimeter.

14. The cleaning system according to claim 13, wherein:
the drying station blows air;
the drying station has a heating device arranged to heat the blowing air;
the drying station has an air conditioning apparatus arranged to dry the blowing air; and
the drying station has suction equipment arranged to support the drying of the atomizer through air suction.

15. The cleaning system according to claim 1, wherein:
the atomizer internal rinsing station has an essentially tubular receptacle to receive at least one of the coating agent and the rinsing agent from the atomizer; and
the receptacle is connected via a pipeline with a disposal system.

16. A cleaning system for cleaning an atomizer comprising:
a cleaning station;
at least one cleaning brush at the cleaning station for cleaning the atomizer, the cleaning brush is adapted to the atomizer, so that the cleaning brush nestles against the atomizer during cleaning; and
a drying station arranged to dry the atomizer; wherein
the drying station includes a pivotable stirrup and a stationary stirrup, which each have at least one nozzle, wherein the nozzle is oriented toward a space provided for the atomizer; and
the stationary stirrup and the pivotable stirrup run essentially vertical and sidewards near the atomizer space.

17. The cleaning system according to claim 16, wherein:
the cleaning brush is rotatably mounted and driven about a rotation axis;
the brush contour of the cleaning brush is essentially rotationally symmetrical with respect to the rotation axis; and
the cleaning brush is moveable around a circular path.

18. The cleaning system according to claim 16, wherein:
the cleaning device has a plurality of cleaning brushes rotatably mounted on respective stationary rotation axes;
the cleaning brushes are arranged with their rotation axes essentially parallel to one another and equidistant from a central point; and
the cleaning brushes respectively have a rotationally symmetrical brush contour.

19. The cleaning system according to claim 16, wherein:
the cleaning brush is rotatably mounted and driven about a second rotation axis;
the cleaning brush is arranged radially spaced apart from the second rotation axis and faces towards the second rotation axis, so that the cleaning brush carries out a circumferential movement about a space provided for the atomizer;
the cleaning brush is arranged on the inner side of a pot-shaped receptacle, wherein the pot-shaped receptacle rotates about the second rotation axis;
the pot-shaped receptacle is arranged to hold a liquid; and
the cleaning brush has on the side at least one insertion opening in order to allow the atomizer into the cleaning brush transversely with respect to the second rotation axis.

20. The cleaning system according to claim 17, further comprising a planetary gear connected to the cleaning brush and the circular path.

21. The cleaning system according to claim 16, wherein:
the cleaning brush has a plurality of brush disks that are rotatable about a common rotation axis and are arranged one above the other along the common rotation axis;
the cleaning brush has between 2 and 10 brush disks;
the cleaning brush has brush fibers with a length of 30 millimeters to 120 millimeters;
the cleaning brush has a plurality of brush bunches with a plurality of brush fibers each, wherein the brush bunches are spaced apart by a distance of 4 millimeters to 10 millimeters;
the individual brush bunches have a diameter of 2.5 millimeters to 7 millimeters;
the individual brush fibers have a diameter of 0.15 millimeter to 1 millimeter;
the individual brush fibers have a cross section which is round, star-shaped, triangular or polygonal;
the individual brush fibers have with respect to the respective cross-sections a tilt angle, which is in the range of 10° to 90°;
the cleaning brush has during operation an immersion depth, which is in the range of 5 millimeters to 40 millimeters;
the individual brush fibers consist of polyamide; and
the cleaning brush has a brush base body, in which the cleaning fibers are secured.

* * * * *